US009224406B2

(12) United States Patent
Bonada et al.

(10) Patent No.: US 9,224,406 B2
(45) Date of Patent: Dec. 29, 2015

(54) TECHNIQUE FOR ESTIMATING PARTICULAR AUDIO COMPONENT

(75) Inventors: Jordi Bonada, Barcelona (ES); Jordi Janer, Barcelona (ES); Ricard Marxer, Barcelona (ES); Yasuyuki Umeyama, Hamamatsu (JP); Kazunobu Kondo, Hamamatsu (JP); Francisco Garcia, Berlin (DE)

(73) Assignee: Yamaha Corporation, Hamamatsu-shi (JP)

( * ) Notice: Subject to any disclaimer, the term of this patent is extended or adjusted under 35 U.S.C. 154(b) by 901 days.

(21) Appl. No.: 13/284,170

(22) Filed: Oct. 28, 2011

(65) Prior Publication Data

US 2012/0106746 A1 May 3, 2012

(30) Foreign Application Priority Data

Oct. 28, 2010 (JP) ..... 2010-242245
Mar. 3, 2011 (JP) ..... 2011-045975

(51) Int. Cl.
*H04R 29/00* (2006.01)
*G10L 25/90* (2013.01)

(52) U.S. Cl.
CPC ..... *G10L 25/90* (2013.01); *G10H 2210/066* (2013.01); *G10H 2210/091* (2013.01)

(58) Field of Classification Search
CPC ..... G10L 2025/906
USPC ..... 381/56, 61, 98, 102, 110, 123; 84/616, 84/654; 704/208, 214
See application file for complete search history.

(56) References Cited

U.S. PATENT DOCUMENTS

| | | | | |
|---|---|---|---|---|
| 4,912,764 | A * | 3/1990 | Hartwell et al. | 704/261 |
| 5,754,974 | A * | 5/1998 | Griffin et al. | 704/206 |
| 7,092,881 | B1 * | 8/2006 | Aguilar et al. | 704/233 |
| 2003/0135374 | A1 * | 7/2003 | Hardwick | 704/264 |
| 2005/0143978 | A1 * | 6/2005 | Martin et al. | 704/208 |

(Continued)

FOREIGN PATENT DOCUMENTS

| | | | |
|---|---|---|---|
| EP | 2 187 385 | A1 | 5/2010 |
| JP | 2001-125562 | A | 5/2001 |
| WO | WO 00/31721 | A1 | 6/2000 |

OTHER PUBLICATIONS

Extended European Search Report dated Oct. 1, 2013 (six (6) pages).

(Continued)

*Primary Examiner* — Joseph Saunders, Jr.
*Assistant Examiner* — James Mooney
(74) *Attorney, Agent, or Firm* — Crowell & Moring LLP

(57) ABSTRACT

Candidate frequencies per unit segment of an audio signal are identified. First processing section identifies an estimated train that is a time series of candidate frequencies, each selected for a different one of the segments, arranged over a plurality of the unit segments and that has a high likelihood of corresponding to a time series of fundamental frequencies of a target component. Second processing section identifies a state train of states, each indicative of one of sound-generating and non-sound-generating states of the target component in a different one of the segments, arranged over the unit segments. Frequency information which designates, as a fundamental frequency of the target component, a candidate frequency corresponding to the unit segment in the estimated train is generated for each unit segment corresponding to the sound-generating state. Frequency information indicative of no sound generation is generated for each unit segment corresponding to the non-sound-generating state.

12 Claims, 10 Drawing Sheets

(56) References Cited

U.S. PATENT DOCUMENTS

| | | | | |
|---|---|---|---|---|
| 2005/0143983 | A1* | 6/2005 | Chang et al. | 704/218 |
| 2005/0149321 | A1 | 7/2005 | Kabi et al. | |
| 2008/0202321 | A1* | 8/2008 | Goto et al. | 84/616 |

OTHER PUBLICATIONS

A. P. Klapuri, "Multiple fundamental frequency estimation based on harmonicity and spectral smoothness", IEEE Transactions on Speech and Audio Processing, Nov. 2003, vol. 11, No. 6, pp. 804-816 (Fourteen (14) pages).

A. Roebel, "Onset Detection in Polyphonic Signals by means of Transient Peak Classification", IRCAM, 1, place Igor Stravinsky 75004, Paris France, roebel@ircam.fr (Six (6) pages).

M. Vinyes et al., "Demixing Commercial Music Productions via Human-Assisted Time-Frequency Masking", Audio Engineering Society, Convention Paper, 120th Convention, May 20-23, 2006, pp. 1-9, Paris, France.

* cited by examiner

TECHNIQUE FOR ESTIMATING PARTICULAR AUDIO COMPONENT

BACKGROUND

The present invention relates to a technique for estimating a time series of fundamental frequencies of a particular audio component (hereinafter referred to as "target component") of an audio signal.

Heretofore, various techniques have been proposed for estimating a fundamental frequency (pitch) of a particular target component of an audio signal where a plurality of audio components (such as singing and accompaniment sounds) exist in a mixed fashion. Japanese Patent Application Laid-open Publication No. 2001-125562 (hereinafter referred to as "the patent literature"), for example, discloses a technique, according to which an audio signal is approximated as a mixed distribution of a plurality of sound models presenting harmonics structures of different fundamental frequencies, probability density functions of the fundamental frequencies are sequentially estimated on the basis of weightings of the individual sound models, and a trajectory of fundamental frequencies corresponding to prominent ones of a plurality of peaks present in the probability density functions is identified. For analysis of the plurality of peaks present in the probability density functions, a multi-agent model is employed which causes a plurality of agents to track the individual peaks.

With the technique of the patent literature, however, the peaks of the probability density functions are tracked under the premise of temporal continuity of the fundamental frequencies, and thus, in a case where sound generation of the target component stops or breaks often (i.e., presence/absence of the fundamental frequency of the target component often changes over time), it is not possible to accurately identify a time series of the fundamental frequencies of the target component.

SUMMARY OF THE INVENTION

In view of the foregoing prior art problems, the present invention seeks to provide a technique for accurately identifying a fundamental frequency of a target component of an audio signal even when sound generation of the target component breaks.

In order to accomplish the above-mentioned object, the present invention provides an improved audio processing apparatus, which comprises: a frequency detection section which identifies, for each of unit segments of an audio signal, a plurality of fundamental frequencies; a first processing section which identifies, through a path search based on a dynamic programming scheme, an estimated train that is a series of fundamental frequencies, each selected from the plurality of fundamental frequencies of a different one of the unit segments, arranged sequentially over a plurality of the unit segments and that has a high likelihood of corresponding to a time series of fundamental frequencies of a target component of the audio signal; a second processing section which identifies, through a path search based on a dynamic programming scheme, a state train that is a series of sound generation states, each indicative of one of a sound-generating state and non-sound-generating state of the target component in a different one of the unit segments, arranged sequentially over the plurality of the unit segments; and an information generation which generates frequency information for each of the unit segments, the frequency information generated for each unit segment corresponding to the sound-generating state in the state train being indicative of one of the selected fundamental frequencies in the estimated train that corresponds to the unit segment, the frequency information generated for each unit segment corresponding to the non-sound-generating state in the state train being indicative of no sound generation for the unit segment.

With the aforementioned arrangements, the frequency information is generated for each of the unit segments by use of the estimated train where fundamental frequencies, having a high likelihood of corresponding to the target component of the audio signal and selected, unit segment by unit segment, from among the plurality of fundamental frequencies detected by the frequency detection section are arranged over the plurality of the unit segments, and the state train where data indicative of presence/absence of the target component and estimated, unit segment by unit segment, are arranged over the plurality of the unit segments. Thus, the present invention can appropriately detect a time series of fundamental frequencies of the target component even when sound generation of the target component breaks.

In a preferred embodiment, the frequency detection section calculates a degree of likelihood with which each frequency component corresponds to the fundamental frequency of the audio signal and selects, as fundamental frequencies, a plurality of the frequencies having a high degree of the likelihood, and the first processing section calculates, for each of the unit segments and for each of the plurality of the frequencies, a probability corresponding to the degree of likelihood and identifies the estimated train through a path search using the probability calculated for each of the unit segments and for each of the plurality of the frequencies. Because the probability corresponding to the degree of likelihood calculated by the frequency detection section is used for identification of the estimated train, the present invention can advantageously identify, with a high accuracy and precision, a time series of fundamental frequencies of the target component having a high intensity in the audio signal.

The audio processing apparatus of the present invention may further comprise an index calculation section which calculates, for each of the unit segments and for each of the plurality of the frequencies, an characteristic index value indicative of similarity and/or dissimilarity between an acoustic characteristic of each of harmonics components corresponding to the fundamental frequencies of the audio signal detected by the frequency detection section and an acoustic characteristic corresponding to the target component. In this case, the first processing section identifies the estimated train through a path search using a provability calculated for each of the unit segments and for each of the plurality of the fundamental frequencies in accordance with the characteristic index value calculated for the unit segment. Because the provability corresponding to the characteristic index value indicative of similarity and/or dissimilarity between the acoustic characteristic of each of harmonics components corresponding to the fundamental frequencies of the audio signal and the acoustic characteristic corresponding to the target component is used for the identification of the estimated train, the present invention can advantageously identify, with a high accuracy and precision, a time series of fundamental frequencies of the target component having a predetermined acoustic characteristic.

In a further preferred embodiment, the second processing section identifies the state train through a path search using probabilities of the sound-generating state and the non-sound-generating state calculated for each of the unit segments in accordance with the characteristic index value of the unit segment corresponding to any one of the fundamental frequencies in the estimated train. Because the probabilities corresponding to the characteristic index value of the unit segment are used for the identification of the estimated train, the present invention can advantageously identify presence or absence of the target component with a high accuracy and precision.

In a preferred embodiment, the first processing section identifies the estimated train through a path search using a probability calculated, for each of combinations between the fundamental frequencies identified by the frequency detection section for each one of the plurality of unit segments and the fundamental frequencies identified by the frequency detection section for the unit segment immediately preceding the one unit segment, in accordance with differences between the fundamental frequencies identified for the one unit segment and the fundamental frequencies identified for the immediately-preceding unit segment. Because the probability calculated for each of combinations of between the fundamental frequencies identified in the adjoin unit segments in accordance with differences between the fundamental frequencies in the adjoining unit segments is used for the search for the estimated train, the present invention can prevent erroneous detection of an estimated train where the fundamental frequency varies excessively in a short time.

In a preferred embodiment, the second processing section identifies the state train through a path search using a probability calculated for a transition between the sound-generating states in accordance with a difference between the fundamental frequency of each one of the unit segments in the estimated train and the fundamental frequency of the unit segment immediately preceding the one unit segment in the estimated train, and a probability calculated for a transition from one of the sound-generating state and the non-sound-generating state to the non-sound-generating state between adjoining ones of the unit segments. Because the probabilities corresponding to differences between the fundamental frequencies in the adjoining unit segments are used for the search for the estimated train, the present invention can prevent erroneous detection of a state train indicative of an inter-sound-generation-state transition where the fundamental frequency varies excessively in a short time.

Further, the audio processing apparatus of the present invention may further comprise: a storage device constructed to supply a time series of reference tone pitches; and a tone pitch evaluation section which calculates, for each of the plurality of unit segments, a tone pitch likelihood corresponding to a difference between each of the plurality of fundamental frequencies detected by the frequency detection section for the unit segment and the reference tone pitch corresponding to the unit segment. In this case, the first processing section identifies the estimated train through a path search using the tone pitch likelihood calculated for each of the plurality of fundamental frequencies, and the second processing section identifies the state train through a path search using probabilities of the sound-generating state and the non-sound-generating state calculated for each of the unit segments in accordance with the tone pitch likelihood corresponding to the fundamental frequency in the estimated train. Because the tone pitch likelihood corresponding to a difference between each of the plurality of fundamental frequencies detected by the frequency detection section for the unit segment and the reference tone pitch corresponding to the unit segment is used for the path searches by the first and second processing sections, the present invention can advantageously identify fundamental frequencies of the target component with a high accuracy and precision. This preferred embodiment will be described later as a second embodiment of the present invention.

The audio processing apparatus of the present invention may further comprise: a storage device constructed to supply a time series of reference tone pitches; and a correction section which corrects the fundamental frequency, indicated by the frequency information, by a factor of 1/1.5 when the fundamental frequency indicated by the frequency information is within a predetermined range including a frequency that is one and half times as high as the reference tone pitch at a time point corresponding to the frequency information and which corrects the fundamental frequency, indicated by the frequency information, by a factor of 1/2 when the fundamental frequency is within a predetermined range including a frequency that is two times as high as the reference tone pitch. Because the fundamental frequency indicated by the frequency information is corrected (e.g., five-degree error and octave error are corrected) in accordance with the reference tone pitches, the present invention can identify fundamental frequencies of the target component with a high accuracy and precision. This preferred embodiment will be described later as a third embodiment of the present invention.

The aforementioned various embodiments of the audio processing apparatus can be implemented not only by hardware (electronic circuitry), such as a DSP (Digital Signal Processor) dedicated to generation of the processing coefficient train but also by cooperation between a general-purpose arithmetic processing device and a program. The present invention may be constructed and implemented not only as the apparatus discussed above but also as a computer-implemented method and a storage medium storing a software program for causing a computer to perform the method. According to such a software program, the same behavior and advantageous benefits as achievable by the audio processing apparatus of the present invention can be achieved. The software program of the present invention is provided to a user in a computer-readable storage medium and then installed into a user's computer, or delivered from a server apparatus to a user via a communication network and then installed into a user's computer.

The following will describe embodiments of the present invention, but it should be appreciated that the present invention is not limited to the described embodiments and various modifications of the invention are possible without departing from the fundamental principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

Figure 1:
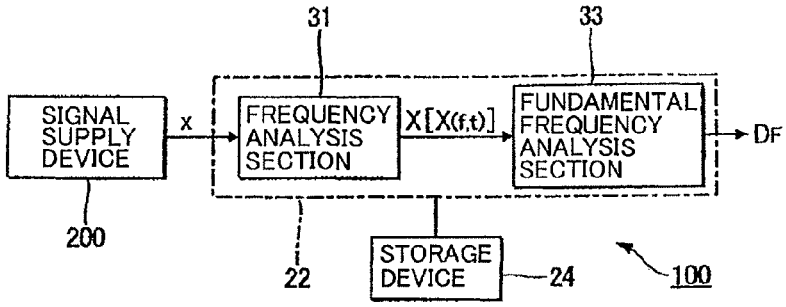
FIG. 1 is a block diagram showing a first embodiment of an audio processing apparatus of the present invention.

A. First Embodiment:

FIG. 1 is a block diagram showing a first embodiment of an audio processing apparatus 100 of the present invention, to which is connected a signal supply device 200. The signal supply device 200 supplies the audio processing apparatus 100 with an audio signal x representative of a time waveform of a mixed sound of a plurality of audio components (such as singing and accompaniment sounds) generated by different sound sources. As the signal supply device 200 can be employed a sound pickup device that picks up ambient sounds to generate an audio signal x, a reproduction device that acquires an audio signal x from a portable or built-in recording medium (such as a CD) to supply the acquired audio signal x to the audio processing apparatus 100, or a communication device that receives an audio signal x from a communication network to supply the received audio signal x to the audio processing apparatus 100.

Sequentially for each of unit segments (frames) of the audio signal x supplied by the signal supply device 200, the audio processing apparatus 100 generates frequency information $D_F$ indicative of a fundamental frequency of a particular audio component (target component) of the audio signal x.

As shown in FIG. 1, the audio apparatus 100 is implemented by a computer system comprising an arithmetic processing device 22 and a storage device 24. The storage device 24 stores therein programs to be executed by an arithmetic processing device 22 and various information to be used by the arithmetic processing device 22. Any desired conventionally-known recording or storage medium, such as a semiconductor storage medium or magnetic storage medium, may be employed as the storage device 24. As an alternative, the audio signal x may be prestored in the storage device 24, in which case the signal supply device 200 may be dispensed with.

By executing any of the programs stored in the storage device 24, the arithmetic processing device 22 performs a plurality of functions (such as functions of a frequency analysis section 31 and fundamental frequency analysis section 33. Note that the individual functions of the arithmetic processing device 22 may be distributed in a plurality of separate integrated circuits, or may be performed by dedicated electronic circuitry (DSP).

The frequency analysis section 31 generates frequency spectra X for each of the unit segments obtained by segmenting the audio signal x on the time axis. The frequency spectra X are complex spectra represented by a plurality of frequency components X (f,t) corresponding to different frequencies (frequency bands) f. "t" indicates time (e.g., Nos. of the unit segments Tu). Generation of the frequency spectra X may be performed using, for example, by any desired conventionally-known frequency analysis, such as the short-time Fourier transform.

The fundamental frequency analysis section 33 generates, for each of the unit segments (i.e., per unit segment) Tu, frequency information $D_F$ by analyzing the frequency spectra X, generated by the frequency analysis section 31, to identify a time series of fundamental frequencies Ftar ("tar" means "target"). More specifically, frequency information $D_F$ designating a fundamental frequency Ftar of the target component is generated for each unit segment Tu where the target component exists, while frequency information $D_F$ indicative of non sound generation (silence) is generated for each unit segment Tu where the target component does not exist.

Figure 2:
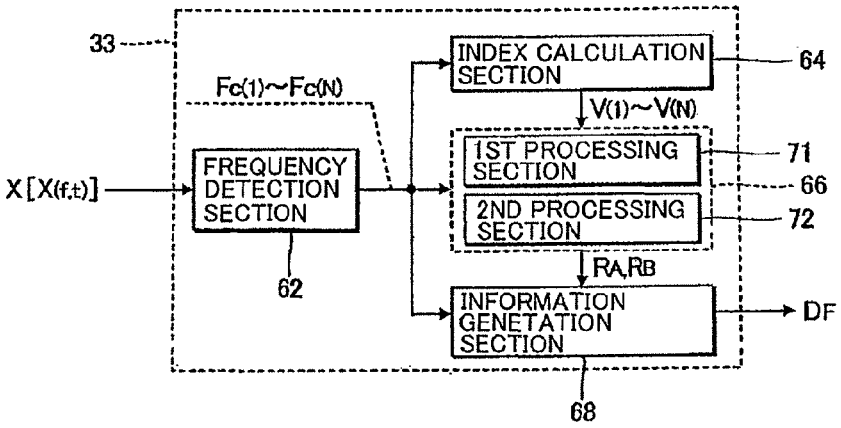
FIG. 2 is a block diagram showing details of a fundamental frequency analysis section provided in the first embodiment.

FIG. 2 is a block diagram showing details of the fundamental frequency analysis section 33. As shown in FIG. 2, the frequency analysis section 33 includes a frequency detection section 62, an index calculation section 64, a transition analysis section 66 and an information generation section 68. The frequency detection section 62 detects, for each of the unit segments Tu, a plurality N frequencies as candidates of fundamental frequencies Ftar of the target component (such candidates will hereinafter be referred as to "candidate frequencies $Fc(1)$ to $Fc(N)$"), and the transition analysis section 66 selects, as a fundamental frequency Ftar of the target component, any one of the N candidate frequencies $Fc(1)$ to $Fc(N)$ for each unit segment Tu where the target component exists. The index calculation section 64 calculates, for each of the unit segments Tu, a plurality of N characteristic index values $V(1)$ to $V(N)$ to be applied to the analysis process by the transition analysis section 66. The information generation section 68 generates and outputs frequency information $D_F$ corresponding to results of the analysis process by the transition analysis section 66. Functions of the individual elements or components of the fundamental frequency analysis section 33 will be discussed below.

<Frequency Detection Section 62>

Figure 3:
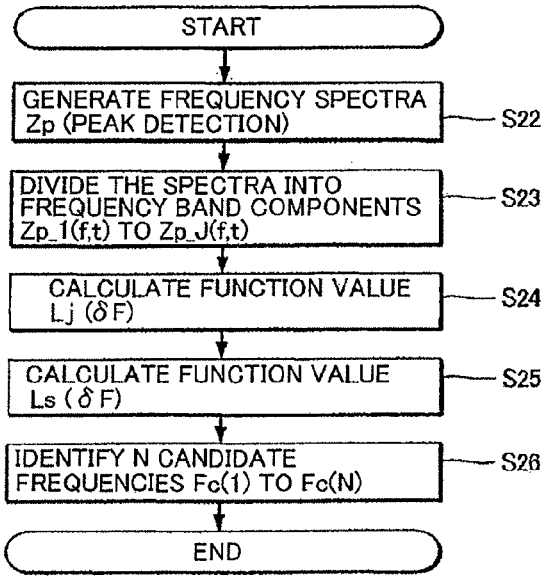
FIG. 3 is a flow chart showing an example operational sequence of a process performed by a frequency detection section in the first embodiment.

The frequency detection section 62 detects N candidate frequencies Fc(1) to Fc(N) corresponding to individual audio components of the audio signal x. Whereas the detection of the candidate frequencies Fc(n) may be made by use of any desired conventionally-known technique, a scheme or process illustratively described below with referent to FIG. 3 is particularly preferable among others. Details of the process of FIG. 3 are disclosed in "Multiple fundamental frequency estimation based on harmonicity and spectral smoothness" by A. P. Klapuri, IEEE Trans. Speech and Audio Proc., 11(6), 804-816, 2003.

Upon start of the process of FIG. 3, the frequency detection section 62 generates frequency spectra Zp with peaks of the frequency spectra X, generated by the frequency analysis section 31, emphasized, at step S22. More specifically, the frequency detection section 62 calculates frequency components Zp(f) of individual frequencies f of the frequency spectra Zp through computing of mathematical expression (1A) to mathematical expression (1C) below $$Zp(f, t) = \max\{0, \zeta(f, t) - Xa\} \tag{1A}$$

$$\zeta(f, t) = \ln\left\{1 + \frac{1}{\eta} X(f, t)\right\} \tag{1B}$$

$$\eta = \left[\frac{1}{k_1 - k_0 + 1} \sum_{l=k_0}^{k_1} X(l, t)^{1/3}\right]^3 \tag{1C}$$

Constants k0 and k1 in mathematical expression (1C) are set at respective predetermined values (for example, k0=50 Hz, and k1=6 kHz). Mathematical expression (1B) is intended to emphasize peaks in the frequency spectra X. Further, "Xa" in mathematical expression (1A) represents a moving average, on the frequency axis, of a frequency component X(f,t) of the frequency spectra X. Thus, as seen from mathematical expression (1A), frequency spectra Zp are generated in which a frequency component Zp(f,t) corresponding to a peak in the frequency spectra X takes a maximum value and a frequency component Zp(f,t) between adjoining peaks takes a value "0".

The frequency detection section 62 divides the frequency spectra Zp into a plurality J of frequency band components Zp_1(f,t) to Zp_J(f,t), at step S23. The j-th (j=1–J) frequency band component Zp_J(f), as expressed in mathematical expression (2) below, is a component obtained by multiplying the frequency spectra Zp (frequency components Zp(f,t)), generated at step S22, by a window function Wj(f).

$$Zp_j(f,t) = Wj(f) \cdot Zp(f,t) \quad \ldots (2)$$

Figure 4:
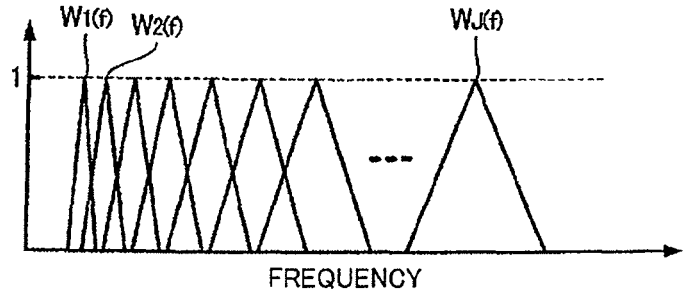
FIG. 4 is a schematic diagram showing window functions for generating frequency band components.
Figure 5:
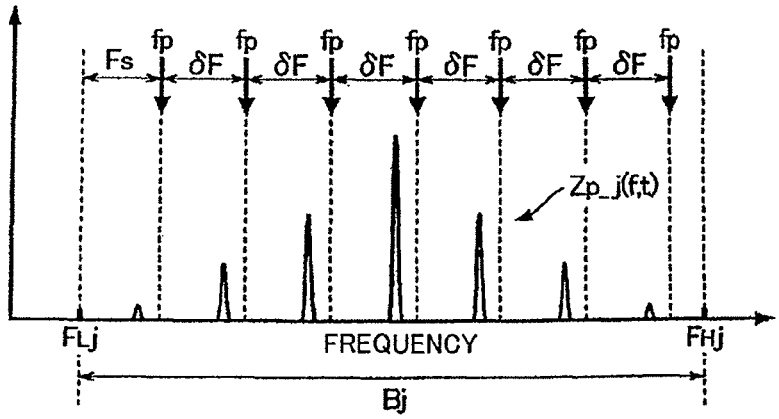
FIG. 5 is a diagram explanatory of behavior of the frequency detection section.

"Wj(f)" in mathematical expression (2) represents the window function set on the frequency axis. In view of human auditory characteristics (Mel scale), the window functions W1(f) to WJ(f) are set such that window resolution decreases as the frequency increases as shown in FIG. 4. FIG. 5 shows the j-th frequency band component Zp_j(f,t) generated at step S23.

For each of the J frequency band components Zp_1(f,t) to Zp_J(f,t) calculated at step S23, the frequency detection section 62 calculates a function value Lj(δ F) represented by mathematical expression (3) below, at step S24.

$$Lj(\delta F) = \max\{A(Fs, \delta F)\} \tag{3}$$

$$A(Fs, \delta F) = c(Fs, \delta F) \cdot a(Fs, \delta F) = c(Fs, \delta F) \cdot \sum_{i=0}^{I(Fs,\delta F)-1} Zp_j(FLj + Fs + i\delta F)$$

$$I(Fs, \delta F) = \left[\frac{FHj - Fs}{\delta F}\right]$$

$$c(Fs, \delta F) = \left[\frac{0.75}{I(Fs, \delta F)}\right] + 0.25$$

As shown in FIG. 5, the frequency band components Zp_j (f,t) are distributed within a frequency band range Bj from a frequency FLj to a frequency FHj. Within the frequency band range Bj, object frequencies fp are set at intervals (with periods) of a frequency δ F, starting at a frequency (FLj+Fs) higher than the lower-end frequency FLj by an offset frequency Fs. The frequency Fs and the frequency δ F are variable in value. "I(Fs, δ F)" in mathematical expression (3) above represents a total number of the object frequencies fp within the frequency band range Bj. As understood from the foregoing, a function value a(Fs, δ F) corresponds to a sum of the frequency band components Zp_j(f,t) at individual ones of the number I(Fs, δ F) of the object frequencies fp (i.e., sum of the number I(Fs, δ F) of values). Further, a variable "c(Fs, δ F)" is an element for normalizing the function value a(Fs, δF).

Figure 6:
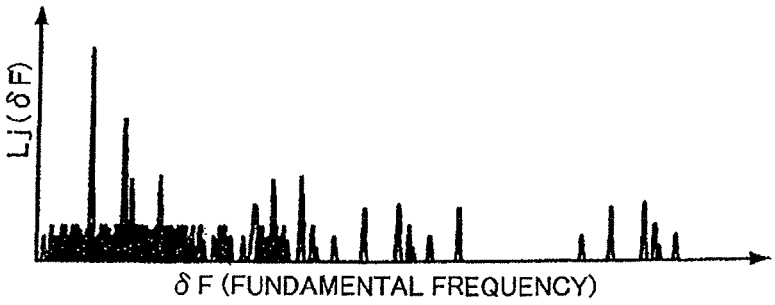
FIG. 6 is a diagram explanatory of an operation performed by the frequency detection section for detecting a fundamental frequency.

"max {A(Fs, δ F)}" in mathematical expression (3) represents a maximum value of a plurality of the function values A(Fs, δ F) calculated for different frequencies Fs. FIG. 6 is a graph showing relationship between a function value Li(δ F) calculated by execution of mathematical expression (3) and frequency δ F of each of the object frequencies fp. As shown in FIG. 6, a plurality of peaks exist in the function value Li(δ F). As understood from mathematical expression (3), the function value Li(δ F) takes a greater value as the individual object frequencies fp, arranged at the intervals of the frequency δ F, become closer to frequencies of corresponding peaks (namely, harmonics frequencies) of the frequency band component Zp_j(f,t). Namely, it is very likely that a particular frequency δ F at which the function value Li(δ F) takes a peak value corresponds to the fundamental frequency F0 of the frequency band component Zp_j(f,t). In other words, if the function value Lj(δ F) calculated for a given frequency δ F takes a peak value, then the given frequency δ F is very likely to correspond to the fundamental frequency F0 of the frequency band component Zp_j(f).

The frequency detection section 62 calculates, at step S25, a function value Ls(δ F) (Ls(δ F)=L1(δ F)+L2(δ F)+L3(δ F)+ . . . +LJ(δ F)) by adding together or averaging the function values Lj(δ F), calculated at step S24 for the individual frequency band component Zp_j(f,t), over the J frequency band components Zp_1(f,t) to Zp_J(f,t). As understood from the foregoing, the function value Ls(δ F) takes a greater value as the frequency δ F is closer to the fundamental frequency F0 of any one of the frequency components of the audio signal x. Namely, the function value Ls(δ F) indicates a degree of likelihood (probability) with which each frequency δ F corresponds to the fundamental frequency F0 of any one of the audio components, and a distribution of the function values Ls(δ F) corresponds to a probability density function of the fundamental frequencies F0 with the frequency δ F used as a random variable.

Further, the frequency detection section 62 selects, from among a plurality of peaks of the degree of likelihood Ls(δ F) calculated at step S25, N peaks in descending order of values of the degrees of likelihood Ls(δ F) at the individual peaks (i.e., N peaks starting with the peak of the greatest degree of likelihood Ls(δ F)), and identifies N frequencies δ F, corresponding to the individual peaks, as candidate frequencies Fc(1) to Fc(N), at step S26. The reason why the frequencies δ F having a great degree of likelihood Ls(δ F) are selected as the candidate frequencies Fc(1) to Fc(N) of the fundamental frequency Ftar of the target component (singing sound) is that the target component, which is a relatively prominent audio component (i.e., audio component having a great sound volume) in the audio signal x, has a tendency of presenting a great value of the degree of likelihood Ls(δ F) as compared to other audio components than the target component. By the aforementioned process (steps S22 to S26) of FIG. 3 being performed sequentially for each of the unit segments Tu, N candidate frequencies Fc(1) to Fc(N) of the M fundamental frequencies F0 are identified for each of the unit segments Tu.

<Index Calculation Section 64>

The index calculation section 64 of FIG. 2 calculates, for each of the N candidate frequencies Fc1 to Fc(N) identified by the frequency detection section 62 at step S26, a characteristic index value V(n) indicative of similarity and/or dissimilarity between a character amount (typically, timbre or tone color character amount) of a harmonics structure included in the audio signal x and corresponding to the candidate frequency Fc(n) (n=1–N) and an acoustic characteristic assumed for the target amount. Namely, the characteristic index value V(n) represents an index that evaluates, from the perspective of an acoustic characteristic, a degree of likelihood of the candidate frequency Fc(n) corresponding to the target component (i.e., degree of likelihood of being a voice in the instant embodiment where the target component is a singing sound). In the following description, let it be assumed that an MFCC (Mel Frequency Cepstral Coefficient) is used as the character amount representative of an acoustic character, although any other type of suitable character amount than such an MFCC may be used.

Figure 7:
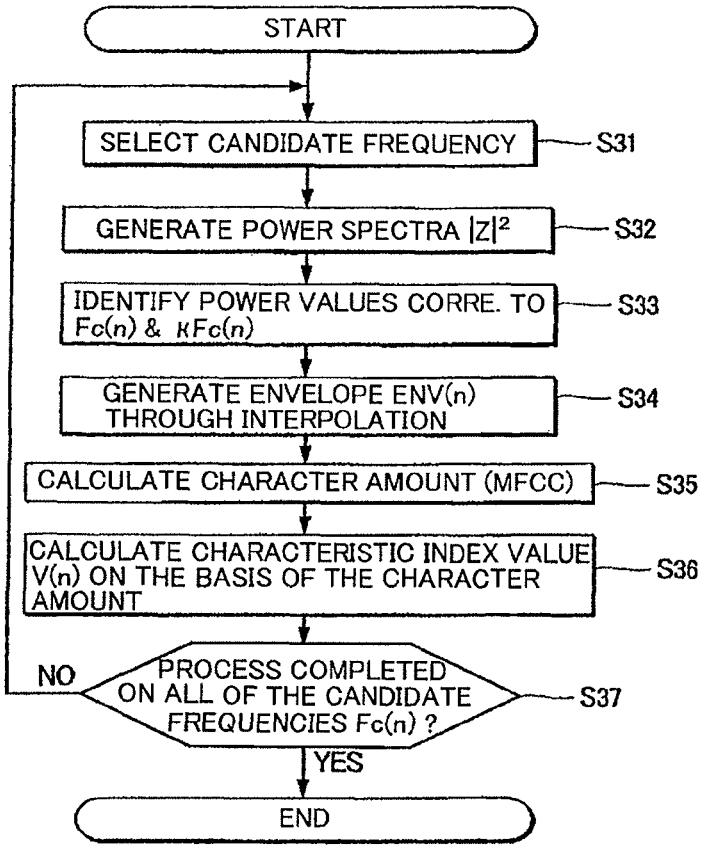
FIG. 7 is a flow chart explanatory of an example operational sequence of a process performed by an index calculation section in the first embodiment.

FIG. 7 is a flow chart explanatory of an example operational sequence of a process performed by the index calculation section 64. A plurality N of characteristic index values V(1) to V(N) are calculated for each of the unit segments Tu by the process of FIG. 7 being performed sequentially for each of the unit segments Tu. Upon start of the process of FIG. 7, the index calculation section 64 selects one candidate frequency Fc(n) from among the N candidate frequencies Fe1 to Fc(N), at step S31. Then, at steps S32 to S35, the index calculation section 64 calculates a character amount (MFCC) of a harmonics structure with the candidate frequency Fc(n), selected at step S31 from among the plurality of audio components of the audio signal x, as the fundamental frequency.

More specifically, the index calculation section 64 generates, at step S32, power spectra $|X|^2$ from the frequency spectra X generated by the frequency analysis section 31, and then identifies, at step S33, power values of the power spectra $|X|^2$ which correspond to the candidate frequency Fc(n) selected at step S31 and harmonics frequencies κFc(n) (κ=2, 3, 4, . . . ) of the candidate frequency Fc(n). For example, the index calculation section 64 multiplies the power spectra $|X|^2$ by individual window functions (e.g., triangular window functions) where the candidate frequency Fc(n) and the individual harmonics frequencies κFc(n) are set on the frequency axis as center frequencies, and identifies maximum products (black dots in FIG. 8), obtained for the individual window functions, as power values corresponding to the candidate frequency Fc(n) and individual harmonics frequencies κFc (n).

Figure 8:
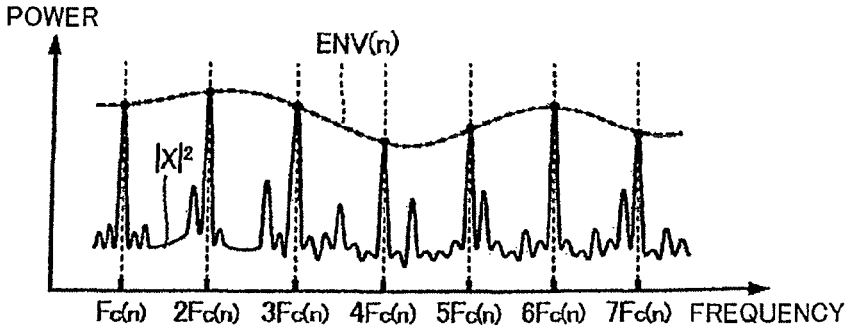
FIG. 8 is a diagram showing an operation performed by the index calculation section for extracting a character amount (MFCC)

The index calculation section 64 generates, at step S34, an envelope Env(n) by interpolating between the power values calculated at step S33 for the candidate frequency Fc(n) and individual harmonics frequencies κFc(n), as shown in FIG. 8. More specifically, the envelope Env(n) is calculated by performing interpolation between logarithmic values (dB values) converted from the power values and then reconverting the interpolated logarithmic values (dB values) back to power values. Any desired conventionally-known interpolation technique, such as the Lagrange interpolation, may be employed for the interpolation at step S34. As understood from the foregoing, the envelope Env(n) corresponds to an envelope of frequency spectra of harmonics components of the audio signal x which have the candidate frequency Fc(n) as the fundamental frequency F0. Then, at step S35, the index calculation section 64 calculates an MFCC (character amount) from the envelope Env(n) generated at step S34. Any desired scheme may be employed for the calculation of the MFCC.

The index calculation section 64 calculates, at step S36, a characteristic index value V(n) (i.e., degree of likelihood of corresponding to the target component) on the basis of the MFCC calculated at step S35. Whereas any desired conventionally-known technique or scheme may be employed for the calculation of the characteristic index value V(n), the SVM (Support Vector Machine) is preferable among others. Namely, the index calculation section 64 learns in advance a separating plane (boundary) for classifying learning samples, where a voice (singing sound) and non-voice sounds (e.g., performance sounds of musical instruments) exist in a mixed fashion, into a plurality of clusters, and sets, for each of the clusters, a probability (e.g., an intermediate value equal to or greater than "0" and equal to or smaller than "1") with which samples within the cluster correspond to the voice. At the time of calculating the characteristic index value V(n), the index calculation section 64 determines, by application of the separating plane, a cluster which the MFCC calculated at step S35 should belong to, and identifies, as the characteristic index value V(n), the probability set for the cluster. For example, the higher the possibility or likelihood with which an audio component corresponding to the candidate frequency V(n) corresponds to the target component (i.e., singing sound), the closer to "1" the characteristic index value V(n) is set at, and, the higher the probability with which the audio component does not correspond to the target component (singing sound), the closer to "0" the characteristic index value V(n) is set at.

Then, at step S37, the index calculation section 64 makes a determination as to whether the aforementioned operations of steps S31 to S36 have been performed on all of the N candidate frequencies Fc1 to Fc(N) (i.e., whether the process of FIG. 7 has been completed on all of the N candidate frequencies Fc1 to Fc(N)). With a negative (NO) determination at step S37, the index calculation section 64 newly selects, at step S31, an unprocessed (not-yet-processed) candidate frequency Fc(n) and performs the operations of steps S32 to S37 on the selected unprocessed candidate frequency Fc(n). Once the aforementioned operations of steps S31 to S36 have been performed on all of the N candidate frequencies Fc1 to Fc(N) (YES determination at step S37), the index calculation section 64 terminates the process of FIG. 7. In this manner, N characteristic index values V(1) to V(N) corresponding to different candidate frequencies Fc(n) are calculated sequentially for each of the unit segments Tu.

<Transition Analysis Section 66>

The transition analysis section 66 of FIG. 2 selects, from among the N candidate frequencies Fc1 to Fc(N) calculated by the frequency detection section 62 for each of the unit segments Tu, a candidate frequency Fc(n) having a high possibility or likelihood of corresponding to the fundamental frequency Ftar of the target component. In this way, a time series (trajectory) of the target frequencies Ftar is identified. As shown in FIG. 2, the transition analysis section 66 includes a first processing section 71 and a second processing section 72, respective functions of which will be detailed hereinbelow.

<First Processing Section 71>

Figure 9:
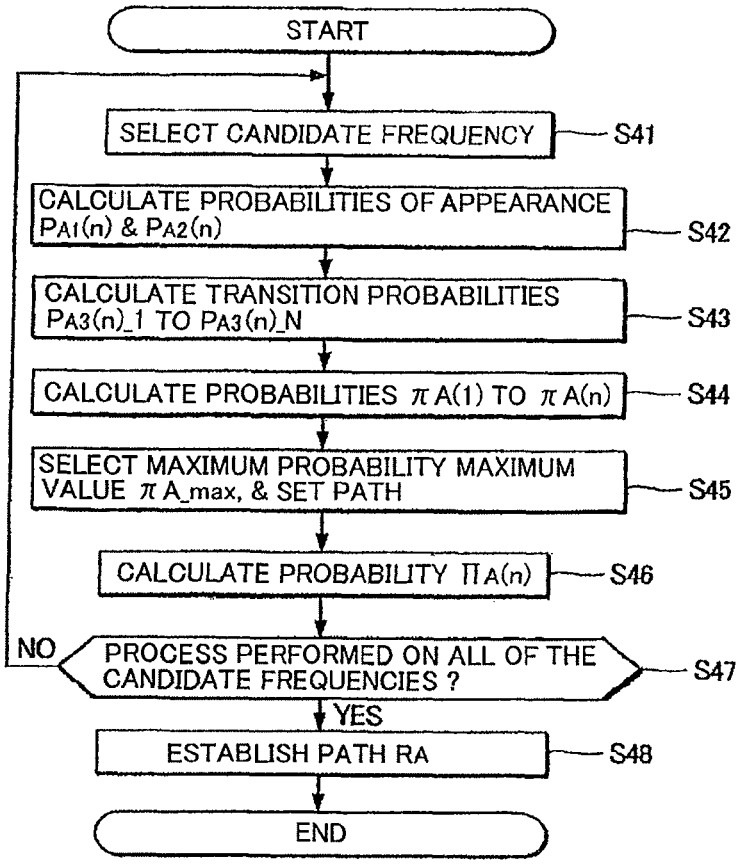
FIG. 9 is a flow chart explanatory of an example operational sequence of a process performed by a first processing section in the first embodiment.

For each of the unit segment Tu, the first processing section 71 identifies, from among the N candidate frequencies Fc1 to Fc(N), a candidate frequency Fc(n) having a high degree of likelihood of corresponding to the target component. FIG. 9 is a flow chart explanatory of an example operational sequence of a process performed by the first processing section 71. The process of FIG. 9 is performed each time the frequency detection section 62 identifies or specifies N candidate frequencies Fc1 to Fc(N) for the latest (newest) unit segment (hereinafter referred to as "new unit segment").

Figure 10:
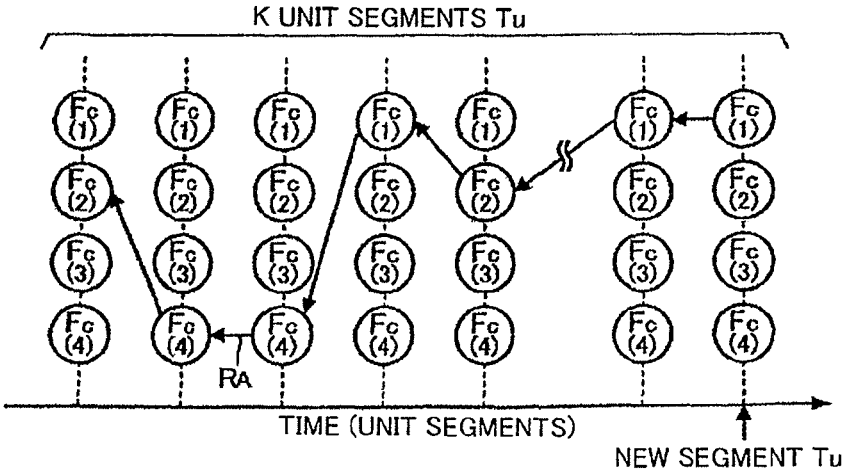
FIG. 10 is a diagram explanatory of an operation performed by the first processing section for selecting a candidate frequency for each unit segment.

Schematically speaking, the process of FIG. 9 is a process for identifying or searching for a path (hereinafter referred to as "estimated train") RA extending over a plurality K of unit segments Tu ending with the new unit segment Tu. The estimated path or train RA represents a time series of candidate frequencies Fc(n) (transition of candidate frequencies Fc(n), each identified as having a high degree of possibility or likelihood of corresponding to the target component among the N candidate frequencies Fc(n) (four candidate frequencies Fc(1) to Fc(4) in the illustrated example of FIG. 10) for a different one of the unit segments Tu, are arranged sequentially or one after another over the K unit segments Tu. Whereas any desired conventionally-known technique may be employed for searching for the estimated train RA, the dynamic programming scheme is preferable among others from the standpoint of reduction in the quantity of necessary arithmetic operations. In the illustrated example of FIG. 9, it is assumed that the path RA is identified using the Viterbi algorithm that is an example of the dynamic programming scheme. The following detail the process of FIG. 9.

Figure 11:
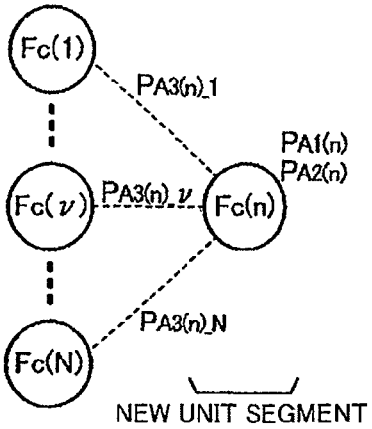
FIG. 11 is a diagram explanatory of probabilities applied to the process performed by the first processing section.

First, the first processing section 71 selects, at step S41, one candidate frequency Fc(n) from among the N candidate frequencies Fc(1) to Fc(N) identified for the new unit segment Tu. Then, as shown in FIG. 11, the first processing section 71 calculates, at step S42, probabilities (PA1(n) and PA2(n)) with which the candidate frequency Fc(n) selected at step S41 appears in the new unit segment Tu, at step S42.

The probability PA1(n) is variably set in accordance with the degree of likelihood Ls(δ F) calculated for the candidate frequency Fc(n) at step S25 of FIG. 3 (Ls(δ F)=Ls(Fc(n)). More specifically, the greater the degree of likelihood Ls(Fc(n) of the candidate frequency Fc(n), the greater value the probability PA1(n) is set at. The first processing section 71 calculates the probability PA1(n) of the candidate frequency Fc(n), for example, by executing mathematical expression (4) below which expresses a normal distribution (average μt A1, dispersion $\sigma_{A}1^2$) with a variable λ(n), corresponding to the degree of likelihood Ls(Fc(n), used as a random variable.

$$P_{A1}(n) = \exp\left(-\frac{\{\lambda(n) - \mu_{A1}\}^2}{2\sigma_{A1}^2}\right) \tag{4}$$

The variable λ(n) in mathematical expression (4) above is, for example, a value obtained by normalizing the degree of likelihood Ls(δ F). Whereas any desired scheme may be employed for normalizing the degree of likelihood Ls(Fc(n)), a value obtained, for example, by dividing the degree of likelihood Ls(Fc(n)) by a maximum value of the degree of likelihood Ls(δ F) is particularly preferable as the normalized degree of likelihood λ(n). Values of the average $\mu_{A}1$ and dispersion $\sigma_{A}1^2$ are selected experimentally or statistically (e.g., $\mu_{A}1=1$, and $\sigma_{A}1^2=0.4$).

The probability PA2(n) calculated at step S42 is variably set in accordance with the characteristic index value V(n) calculated by the index calculation section 64 for the candidate frequency Fc(n). More specifically, the greater the characteristic index value V(n) of the candidate frequency Fc(n) (i.e., the greater the degree of likelihood of the candidate frequency Fc(n) corresponding to the target component), the greater value the probability PA2(n) is set at. The first processing section 71 calculates the probability PA2(n), for example, by executing mathematical expression (5) below which expresses a normal distribution (average $\mu_{A}2$, dispersion $\sigma_{A}2^2$) with the characteristic index value V(n) used as a random variable. Values of the average $\mu_{A}2$ and dispersion $\sigma_{A}2^2$ are selected experimentally or statistically (e.g., $\mu_{A}2=1=\sigma_{A}2^2=1$).

$$p_{A2}(n) = \exp\left(-\frac{\{V(n) - \mu_{A2}\}^2}{2\sigma_{A2}^2}\right) \tag{5}$$

As seen in FIG. 11, the first processing section 71 calculates, at step S43, a plurality N of transition probabilities PA3(n)_1 to PA3(n)__N for individual combinations between the candidate frequency Fc(n), selected for the new unit segment Tu at step S41, and N candidate frequencies Fc(1) to Fc(N) of the unit segment Tu immediately preceding the new unit segment Tu. The probability PA3(n)_ν (ν=1−N) represents a probability with which a transition occurs from a ν-th candidate frequency Fc(ν) of the immediately-preceding unit segment Tu to any one of the candidate frequencies Fc(n) of the new unit segment Tu. More specifically, in view of a tendency that a degree of likelihood of a tone pitch of an audio component varying extremely between the unit segments Tu is low, the greater a difference (tone pitch difference) between the immediately-preceding candidate frequency Fc(ν) and the current candidate frequency Fc(n), the smaller value the probability PA3(n)_ν is set at (namely, the probability PA3(n)_ν is set at a smaller value as the difference (tone pitch difference) between the immediately-preceding candidate frequency Fc(ν) and the current candidate frequency Fc(n) increases. The first processing section 71 calculates the N probabilities PA3(n)_1 to PA3(n)__N, for example, by executing mathematical expression (6) below.

$$p_{A3}(n)_\nu = \exp\left(-\frac{[\min\{6, \max(0, |\varepsilon| - 0.5)\} - \mu_{A3}]^2}{2\sigma_{A3}^2}\right) \tag{6}$$

Namely, mathematical expression (6) expresses a normal distribution (average $\mu_{A}3$, dispersion $\sigma_{A}3^2$) with a function value min {6,max(0,|ϵ|−0.5)} used as a random variable. "ϵ" in mathematical expression (6) represents a variable indicative of a difference in semitones between the immediately-preceding candidate frequency Fc(ν) and the current candidate frequency Fc(n). The function value min {6,max(0,|ϵ|−0.5)} is set at a value obtained by subtracting 0.5 from the above-mentioned difference in semitones ϵ if the thus-obtained value is smaller than "6" ("0" if the thus-obtained value is a negative value), but set at "6" if the thus-obtained value is greater than "6" (i.e., if the immediately-preceding candidate frequency Fc(ν) and the current candidate frequency Fc(n) differ from each other by more than six semitones). Note that the probabilities $P_A3(n)_1$ to $P_A3(n)_N$ of the first unit segment Tu of the audio signal x are set at a predetermined value (e.g., value "1"). Values of the average $\mu_A3$ and dispersion $\sigma_A3^2$ are selected experimentally or statistically (e.g., $\mu_A3=0$, and $=\sigma_A3^2=4$).

Figure 12:
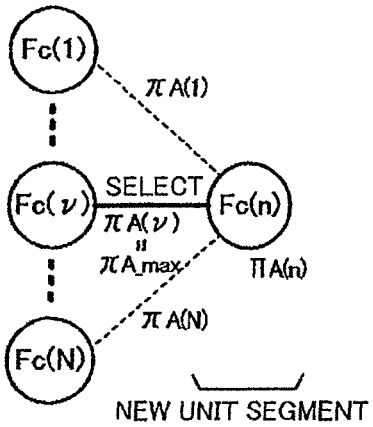
FIG. 12 is a diagram explanatory of probabilities applied to the process performed by the first processing section.

After having calculated the probabilities ($P_A1(n)$, $P_A2(n)$, $P_A3(n)_1-P_A3(n)_N$) in the aforementioned manner, the first processing section 71 calculates, at step S44, N probabilities $\pi_A(1)$ to $\pi_A(n)$ for individual combinations between the candidate frequency Fc(n) of the new unit segment Tu and the N candidate frequencies Fc(1) to Fc(N) of the unit segment Tu immediately preceding the new unit segment Tu, as shown in FIG. 12. The probability $\pi_A(\nu)$ is in the form of a numerical value corresponding to the probability $P_A1(n)$, probability $P_A2(n)$ and probability $P_A3(n)_\nu$ of FIG. 11. For example, a sum of respective logarithmic values of the probability $P_A1(n)$, probability $P_A2(n)$ and probability $P_A3(n)_\nu$ is calculated as the probability $\pi_A(\nu)$ As seen from the foregoing, the probability $\pi_A(\nu)$ represents a probability (degree of likelihood) with which a transition occurs from the ν-th candidate frequency Fc(ν) of the immediately-preceding unit segment Tu to the candidate frequency Fc(n) of the new unit segment Tu.

Then, at step S45, the first processing section 71 selects a maximum value $\pi_A_max$ of the N probabilities $\pi_A(1)$ to $\pi_A(N)$ calculated at step S44, and sets a path (indicated by a heavy line in FIG. 12) interconnecting the candidate frequency Fc(ν) corresponding to the maximum value $\pi_A_max$, of the N candidate frequencies Fc(1) to Fc(N) of the immediately-preceding unit segment Tu and the candidate frequency Fc(n) of the new unit segment Tu as shown in FIG. 12. Further, at step S46, the first processing section 71 calculates a probability $\Pi_A(n)$ for the candidate frequency Fc(n) of the new unit segment Tu. The probability $\Pi_A(n)$ is set at a value corresponding to a probability $\Pi_A(\nu)$ previously calculated for the candidate frequency Fc(ν) selected at step S45 from among the N candidate frequencies Fc(1) to Fc(N) of the immediately-preceding unit segment Tu and to the maximum value $\pi_A_max$ selected at step S45 selected for the current candidate frequency Fc(n); for example, the probability $\Pi_A(n)$ is set at a sum of respective logarithmic values of the previously-calculated probability $\Pi_A(\nu)$ and maximum value $\pi_A_max$.

Then, at step S47, the first processing section 71 makes a determination as to whether the aforementioned operations of steps S41 to S46 have been performed on all of the N candidate frequencies Fc1 to Fc(N) of the new unit segment Tu. With a negative (NO) determination at step S47, the first processing section 71 newly selects, at step S41, an unprocessed candidate frequency Fc(n) and then performs the operations of steps S42 to S47 on the selected unprocessed candidate frequency Fc(n). Namely, the operations of steps S41 to S47 are performed on each of the N candidate frequencies Fc1 to Fc(N) of the new unit segment Tu, so that a path from one particular candidate frequency Fc(ν) of the immediately-preceding unit segment Tu (step S45) and a probability $\Pi_A(n)$ (step S46) corresponding to the path are calculated for each of the candidate frequencies Fc(n) of the new unit segment Tu.

Once the aforementioned process of FIG. 9 has been performed on all of the N candidate frequencies Fc1 to Fc(N) of the new unit segment Tu (YES determination at step S47), the first processing section 71 establishes an estimated train $R_A$ of the candidate frequencies extending over the K unit segments Tu ending with the new unit segment Tu, at step S48. The estimated train $R_A$ is a path sequentially tracking backward the individual candidate frequencies Fc(n), interconnected at step S45, over the K unit segments Tu from the candidate frequency Fc(n) of which the probability $\Pi_A(n)$ calculated at step S46 is the greatest among the N candidate frequencies Fc(1) to Fc(N) of the new unit segment Tu. Note that, as long as the number of the unit segments Tu on which the operations of steps S41 to S47 have been completed is less than K (i.e., as long as the operations of steps S41 to S47 have been performed only for each of the unit segments Tu from the start point of the audio signal x to the (K−1)th unit segment), establishment of the estimated train $R_A$ (step S48) is not effected. As set forth above, each time the frequency detection section 62 identifies N candidate frequencies Fe1 to Fc(N) for the new unit segment Tu, the estimated train $R_A$ extending over the K unit segments Tu ending with the new unit segment Tu is identified.

<Second Processing Section 72>

Note that the audio signal x includes some unit segment Tu where the target component does not exist, such as a unit segment Tu where a singing sound is at a stop. Because the determination about presence/absence of the target component in the individual unit segments Tu is not made at the time of searching, by the first processing section 71, for the estimated train $R_A$, and thus, in effect, the candidate frequency Fc(n) is identified on the estimated train $R_A$ also for such a unit segment Tu where the target component does not exist. In view of the forgoing circumstance, the second processing section 72 determines presence/absence of the target component in each of the K unit segments Tu corresponding to the individual candidate frequencies Fc(n) on the estimated train $R_A$.

Figure 13:
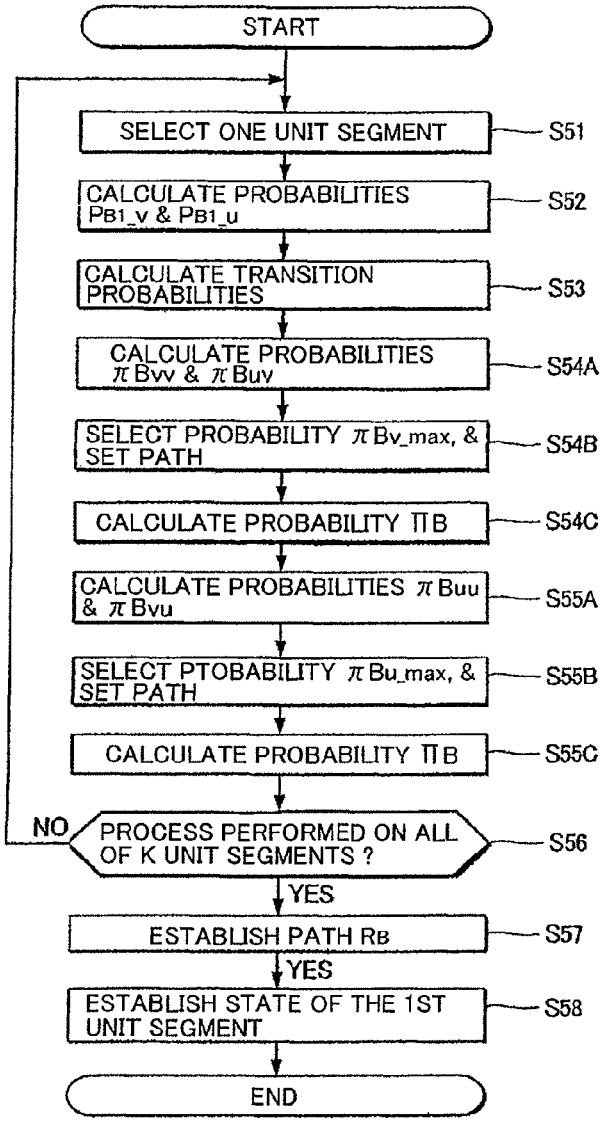
FIG. 13 is a flow chart explanatory of an example operational sequence of a process performed by a second processing section in the first embodiment.
Figure 14:
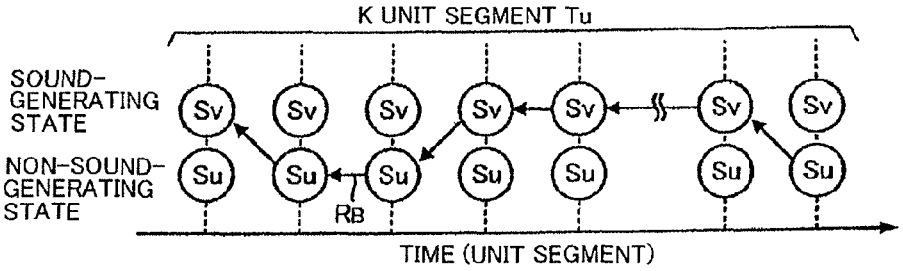
FIG. 14 is a diagram explanatory of an operation performed by the second processing section for determining presence or absence of a target component for each unit segment.

FIG. 13 is a flow chart explanatory of an example operational sequence of a process performed by the second processing section 72. The process of FIG. 13 is performed each time the first processing section 71 identifies an estimated train $R_A$ for each of the unit segments Tu. Schematically speaking, the process of FIG. 13 is a process for identifying a path (hereinafter "state train") $R_B$ extending over the K unit segments Tu corresponding to the estimated train $R_A$, as shown in FIG. 14. The path $R_B$ represents a time series of sound generation states (transition of sound-generating and non-sound-generating states), where any one of the sound-generating (or voiced) state Sv and non-sound-generating (unvoiced) state Su of the target component is selected for each of the K unit segments Tu and the thus-selected individual sound-generating and non-sound-generating states are arranged sequentially over the K unit segments Tu. The sound-generating state Sv is a state where the candidate frequency Fc(n) of the unit segment Tu in question on the estimated train $R_A$ is sounded as the target component, while the non-sound-generating state Su is a state where the candidate frequency Fc(n) of the unit segment Tu in question on the estimated train $R_A$ is not sounded as the target component. Whereas any desired conventionally-known technique may be employed for searching for the state train $R_B$, the dynamic programming scheme is preferred among others from the perspective of reduction in the quantity of necessary arithmetic operations. In the illustrated example of FIG. 13, it is assumed that the state train $R_B$ is identified using the Viterbi algorithm that is an example of the dynamic programming scheme. The following detail the process of FIG. 13.

The second processing section 72 selects, at step S51, any one of the K unit segments Tu; the thus-selected unit segment Tu will hereinafter be referred to as "selected unit segment". More specifically, the first unit segment Tu is selected from among the K unit segments Tu at the first execution of step S51, and then, the unit segment Tu immediately following the last-selected unit segment Tu is selected at the second execution of step S51, then the unit segment Tu immediately following the next last-selected unit segment Tu is selected at the third execution of step S51, and so on.

Figure 15:
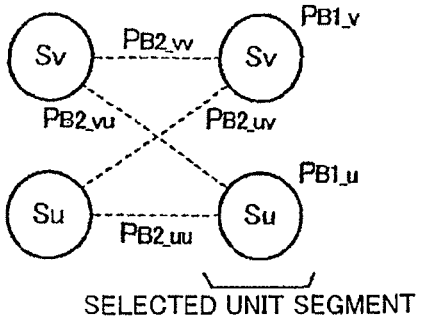
FIG. 15 is a diagram explanatory of probabilities applied to the process performed by the second processing section.

The second processing section 72 calculates, at step S52, probabilities $P_{B}1_v$ and $P_{B}1_u$ for the selected unit segment Tu, as shown in FIG. 15. The probability $P_{B}1_v$ represents a probability with which the target component is in the sound-generating state Sv, while the probability, $P_{B}1_u$ represents a probability with which the target component is in the non-sound-generating state Su.

In view of a tendency that the characteristic index value V(n) (i.e., degree of likelihood of corresponding to the target component), calculated by the index calculation section 64 for the candidate frequency Fc(n), increases as the degree of likelihood of the candidate frequency Fc(n) of the selected unit segment Tu corresponding to the target component increases, the characteristic index value V(n) is applied to the calculation of the probability $P_{B}1_v$ of the sound-generating state. More specifically, the second processing section 72 calculates the probability $P_{B}1_v$ by computing or execution of mathematical expression (7) below that expresses a normal distribution (average $\mu_{B}1$, dispersion $\sigma_{B}1^2$) with the characteristic index value V(n) used as a random variable. As understood from mathematical expression (7), the greater the characteristic index value V(n), the greater value the probability $P_{B}1_v$ is set at. Values of the average $\mu_{B}1$ and dispersion $\sigma_{B}1^2$ are selected experimentally or statistically (e.g., $\mu_{B}1=\sigma_{B}1^2=1$).

$$P_{B1}_v = \exp\left(-\frac{\{V(n)-\mu_{B1}\}^2}{2\sigma_{B1}^2}\right) \tag{7}$$

On the other hand, the probability $P_{B}1_u$ of the non-sound-generating state Su is a fixed value calculated, for example, by execution of mathematical expression (8) below.

$$P_{B1}_u = \exp\left(-\frac{\{0.5-\mu_{B1}\}^2}{2\sigma_{B1}^2}\right) \tag{8}$$

Then, the second processing section 72 calculates, at step S53, probabilities ($P_{B}2_vv$, $P_{B}2_uv$, $P_{B}2_uu$ and $P_{B}2_vu$) for individual combinations between the sound-generating state Sv and non-sound-generating state Su of the selected unit segment Tu and the sound-generating state Sv and non-sound-generating state Su of the unit segment Tu immediately preceding the selected unit segment Tu, as indicated by broken lines in FIG. 15. As understood from FIG. 15, the probability $P_{B}2_vv$ is a probability with which a transition occurs from the sound-generating state Sv of the immediately-preceding unit segment Tu to the sound-generating state Sv of the selected unit segment Tu (namely, vv which means a "voiced→voiced2 transition). Similarly, the probability $P_{B}2_uv$ is a probability with which a transition occurs from the non-sound-generating state Su of the immediately-preceding unit segment Tu to the sound-generating state Sv of the selected unit segment Tu (namely, uv: which means an "unvoiced→voiced" transition), the probability $P_{B}2_uv$ is a probability with which a transition occurs from the non-sound-generating state Su of the immediately-preceding unit segment Tu to the non-sound-generating state Su of the selected unit segment Tu (namely, uu which means a "unvoiced→unvoiced" transition), and the probability $P_{B}2_vu$ is a probability with which a transition occurs from the sound-generating state Sv of the immediately-preceding unit segment Tu to the non-sound-generating state Su of the selected unit segment Tu (namely, vu which means a "voiced→unvoiced"). More specifically, the second processing section 72 calculates the above-mentioned individual probabilities in a manner as represented by mathematical expressions (9A) and (9B) below.

$$P_{B2}_vv = \exp\left(-\frac{[\min\{6, \max(0, |\varepsilon|-0.5)\}-\mu_{B2}]^2}{2\sigma_{B2}^2}\right) \tag{9A}$$

$$P_{B2}_uv = P_{B2}_uu = P_{B2}_vu = 1 \tag{9B}$$

Similarly to the probability $P_{A}3(n)_v$ calculated with mathematical expression (6) above, the greater an absolute value $|\epsilon|$ of a frequency difference $\epsilon$ in the candidate frequency Fc(n) between the immediately-preceding unit segment Tu and the selected unit segment Tu, the smaller value the probability $P_{B}2_vv$ of mathematical expression 9A is set at. Values of the average $\mu_{B}2$ and dispersion $\sigma_{B}2^2$ in mathematical expression (9A) above are selected experimentally or statistically (e.g., $\mu_{B}2=0$, and $\sigma_{B}2^2=4$). As understood from mathematical expressions (9A) and (9B) above, the probability $P_{B}2_vv$ with which the sound-generating state Sv is maintained in the adjoining unit segments Tu is set lower than the probability $P_{B}2_uv$ or $P_{B}2_vu$ with which a transition occurs from any one of the sound-generating state Sv and non-sound-generating state Su to the other in the adjoining unit segments Tu, or the probability $P_{B}2_uu$ with which the non-sound-generating state Su is maintained in the adjoining unit segments Tu.

Figure 16:
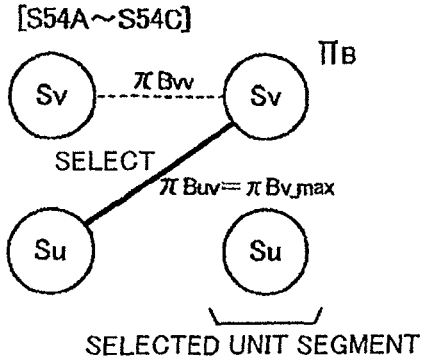
FIG. 16 is a diagram explanatory of probabilities applied to the process performed by the second processing section.

The second processing section 72 selects any one of the sound-generating state Sv and non-sound-generating state Su of the immediately-preceding unit segment Tu in accordance with the individual probabilities ($P_{B}1_v$, $P_{B}2_vv$ and $P_{B}2_uv$) pertaining to the sound-generating state Sv of the selected unit segment Tu and then connects the selected sound-generating state Sv or non-sound-generating state Su to the sound-generating state Sv of the selected unit segment Tu, at steps S54A to S54C. More specifically, the second processing section 72 first calculates, at step S54A, probabilities $\pi_{B}vv$ and $\pi_{B}uv$ with which transitions occur from the sound-generating state Sv and non-sound-generating state Su of the immediately-preceding unit segment Tu to the sound-generating state Sv of the selected unit segment Tu, as shown in FIG. 16. The probability $\pi_{B}vv$ is a probability with which a transition occurs from the sound-generating state Sv of the immediately-preceding unit segment Tu to the sound-generating state Sv of the selected unit segment Tu, and this probability $\pi_{B}vv$ is set at a value corresponding to the probability $P_{B}1_v$ calculated at step S52 and probability $P_{B}2_vv$ calculated at step S53 (e.g., the probability $\pi_{B}vv$ is set at a sum of respective logarithmic values of the probability $P_{B}1_v$ and probability $P_{B}2_vv$). Similarly, the probability $\pi_{B}uv$ is a probability with which a transition occurs from th non-sound-generating state Su of the immediately-preceding unit segment Tu to the sound-generating state Sv of the selected unit segment Tu, and this probability $\pi_{B}uv$ is calculated in accordance with the probability $P_{B}1_v$ and probability $P_{B}2_uv$.

Then, the second processing section 72 selects, at step S54B, one of the sound-generating state Sv and non-sound-generating state Su of the immediately-preceding unit segment Tu which corresponds to a maximum value $\pi_{B}v_max$ (i.e., greater one) of the probabilities $\pi_{B}vv$ and $\pi_{B}uv$ and connects the thus-selected sound-generating state Sv or non-sound-generating state Su to the sound-generating state Sv of the selected unit segment Tu, as shown in FIG. 16. Then, at step S54C, the second processing section 72 calculates a probability $\Pi_B$ for the sound-generating state Sv of the selected unit segment Tu. The probability $\Pi_B$ is set at a value corresponding to a probability $\Pi_B$ previously calculated for the state selected for the immediately-preceding unit segment Tu at step S54B and the maximum value $\pi_{BV}$_max identified at step S54B (e.g., the probability $\Pi_B$ is set at a sum of respective logarithmic values of the probability $\pi_B$ and maximum value $\pi_{BV}$_max).

Figure 17:
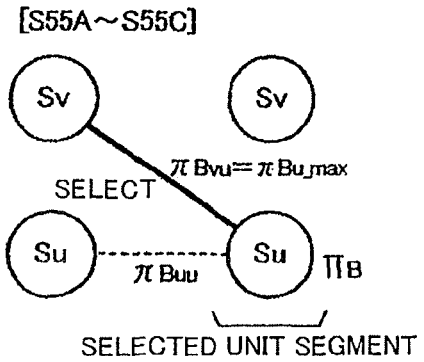
FIG. 17 is a diagram explanatory of probabilities applied to the process performed by the second processing section.

Similarly, for the non-sound-generating state Su of the selected unit segment Tu, the second processing section 72 selects any one of the sound-generating state Sv and non-sound-generating state Su of the immediately-preceding unit segment Tu in accordance with the individual probabilities ($P_B$1_u, $P_B$2_uu and $P_B$2_vu) pertaining to the non-sound-generating state Su of the selected unit segment Tu and then connects the selected sound-generating state Sv or non-sound-generating state Su to the non-sound-generating state Su of the selected unit segment Tu, at step S55A to S55C. Namely, the second processing section 72 calculates, at step S55A, a probability $\pi_{BUU}$ (i.e., probability with which a transition occurs from the non-sound-generating state Su to the non-sound-generating state Su) corresponding to the probability $P_B$1_u and probability $P_B$2_uu, and a probability $\pi_{BVU}$ corresponding to the probability $P_B$1_u and probability $P_B$2_vu. Then, at step S55B, the second processing section 72 selects any one of the sound-generating state Sv and non-sound-generating state Su of the immediately-preceding unit segment Tu which corresponds to a maximum value $\pi_{BU}$_max of the probabilities $\pi_{BUU}$ and $\pi_{BVU}$ (sound-generating state Sv in the illustrated example of FIG. 17) and connects the thus-selected state to the non-sound-generating state Su of the selected unit segment Tu. Then, at step S55C, the second processing section 72 calculates a probability $\Pi_B$ for the non-sound-generating state Su of the selected unit segment Tu in accordance with a probability $\Pi_B$ previously calculated for the state selected at step S55B and the maximum value $\pi_{BU}$_max selected at step S55B.

After having completed the connection with the states of the immediately-preceding unit segment Tu (steps S54B and S55B) and calculation of the probabilities $\Pi_B$ (steps S54C and S55C) for the sound-generating state Sv and non-sound-generating state Su of the selected unit segment Tu in the aforementioned manner, the second processing section 72 makes a determination, at step S56, as to whether the aforementioned process has been completed on all of the K unit segments Tu. With a negative (NO) determination at step S56, the second processing section 72 goes to step S51 to select, as a new selected unit segment Tu, the unit segment Tu immediately following the current selected unit segment Tu, and then the second processing section 72 performs the aforementioned operations of S52 to S56 on the new selected unit segment Tu.

Once the aforementioned process has been completed on all of the K unit segments Tu (YES determination at step S56), the second processing section 72 establishes the state train $R_B$ extending over the K unit segments Tu, at step S57. More specifically, the second processing section 72 establishes the state train $R_B$ by sequentially tracking backward the path, set or connected at step S54B or S55B, over the K unit segments Tu from one of the sound-generating state Sv and non-sound-generating state Su that has a greater probability $\Pi_B$ than the other in the last one of the K unit segments Tu. Then, at step S58, the second processing section 72 establishes the sound generation state (sound-generating state Sv or non-sound-generating state Su) of the first unit segment Tu on the state train $R_B$ extending over the K unit segments Tu, as the sound generation state (i.e., presence or absence of sound generation of the target component) of the first unit segment Tu. Namely, presence or absence (sound-generating state Sv or non-sound-generating state Su) of the target component is determined for (K−1) previous unit segments Tu from the new unit segment Tu.

<Information Generation Section 68>

The information generation section 68 generates and outputs, for each of the unit segments Tu, frequency information $D_F$corresponding to the results (estimated train $R_A$ and state train $R_B$) of the analysis process by the transition analysis section 66. More specifically, for each unit segment Tu corresponding to the sound-generating state Sv in the state train $R_B$ identified by the second processing section 72, the information generation section 68 generates frequency information $D_F$ that designates, as the fundamental frequency Ftar of the target component, one of the K candidate frequencies Fc(n) of the estimated train $R_A$, identified by the first processing section 71, which corresponds to that unit segment Tu. On the other hand, for each unit segment Tu corresponding to the non-sound-generating state Su in the state train $R_B$ identified by the second processing section 72, the information generation section 68 generates frequency information $D_F$ indicative of no sound generation (or silence) of the target component (e.g., frequency information $D_F$ set at a value "0").

In the above-described embodiment, there are generated the estimated train $R_A$ which is indicative of a candidate frequency Fc(n) having a high likelihood of corresponding to the target component selected, for each of the unit segments Tu, from among the N candidate frequencies Fc(1) to Fc(N) detected from the audio signal x, and the state train $R_B$ which is indicative of presence or absence (sound-generating state Sv or non-sound-generating state Su) of the target component estimated for each of the unit segments Tu, and frequency information $D_F$ is generated using both the estimated train $R_A$ and the state train $R_B$. Thus, even when sound generation of the target component breaks, the instant embodiment can appropriately detect a time series of fundamental frequencies Ftar of the target component. For example, as compared to the construction where the transition analysis section 66 includes only the first processing section 71, the instant embodiment can minimize a possibility of a fundamental frequency Ftar being erroneously detected for an unit segment Tu where the target component of the audio signal x does not actually exist.

Further, because the probability $P_A$1(n) corresponding to the degree of likelihood Ls(δ F) with which each frequency δ F corresponds to a fundamental frequency of the audio signal x is applied to searching for the estimated train $R_A$, the instant embodiment can advantageously identify, with a high accuracy and precision, a time series of fundamental frequencies of the target component having a high intensity in the audio signal x. Further, because the probability $P_A$2(n) and probability $P_B$1(n)_v corresponding to the characteristic index value V(n), indicative of similarity and/or dissimilarity between an acoustic characteristic of one of harmonics components corresponding to the candidate frequencies Fc(n) of the audio signal x and a predetermined acoustic characteristic, are applied to searching for the estimated train $R_A$ and state train $R_B$. Thus, the instant embodiment can identify a time series of fundamental frequencies Ftar (presence/absence of sound generation) of the target component of predetermined acoustic characteristics with a high accuracy and precision.

B. Second Embodiment

Next, a description will be given about a second embodiment of the present invention, where elements similar in construction and function to those in the first embodiment are indicated by the same reference numerals and characters as used for the first embodiment and will not be described in detail here to avoid unnecessary duplication.

Figure 18:
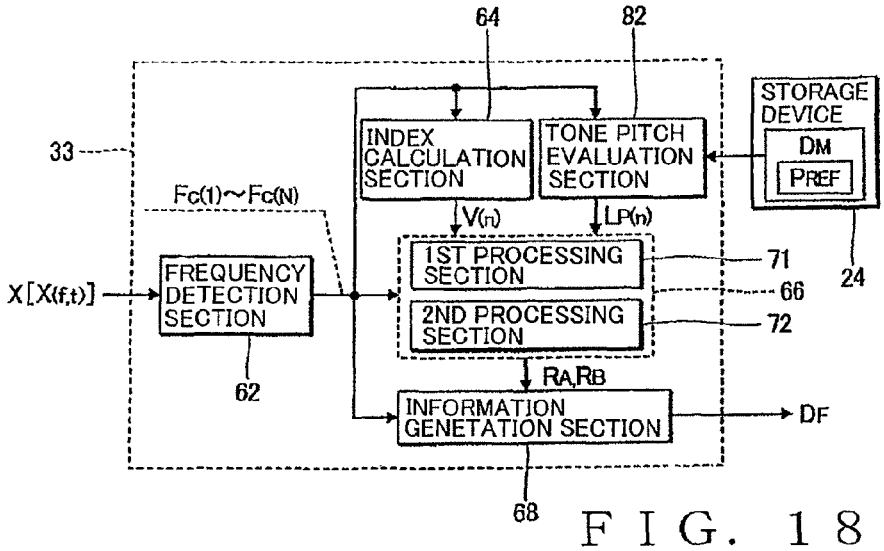
FIG. 18 is a block diagram showing details of a fundamental frequency analysis section provided in a second embodiment.

FIG. 18 is a block diagram showing the fundamental frequency analysis section 33 provided in the second embodiment, in which is also shown the storage device 24. Music piece information $D_M$ is stored in the storage device 24. The music piece information $D_M$ designates, in a time-serial manner, tone pitches $P_{REF}$ of individual notes constituting a music piece (such tone pitches $P_{REF}$ will hereinafter be referred to as "reference tone pitches $P_{REF}$". In the following description, let it be assumed that tone pitches of a singing sound representing a melody (guide melody) of the music piece are designated as the reference tone pitches $P_{REF}$. Preferably, the music piece information $D_M$ comprises, for example, a time series of data of the MIDI (Musical Instrument Digital Interface) format, in which event data (note-on event data) designating tone pitches of the music piece and timing data designating processing time points of the individual event data are arranged in a time-serial fashion.

A music piece represented by the audio signal x which is an object of processing in the second embodiment is the same as the music piece represented by the music piece information $D_M$ stored in the storage device 24. Thus, a time series of tone pitches represented by the target component (singing sound) of the audio signal x and a time series of the reference tone pitches $P_{REF}$ designated by the music piece information $D_M$ correspond to each other on the time axis. The fundamental frequency analysis section 33 in the second embodiment uses the time series of the reference tone pitches $P_{REF}$, designated by the music piece information $D_M$, to identify a time series of fundamental frequencies Ftar of the target component of the audio signal x.

As shown in FIG. 18, the fundamental frequency analysis section 33 in the second embodiment includes a tone pitch evaluation section 82, in addition to the same components (i.e., frequency detection section 62, index calculation section 64, transition analysis section 66 and information generation section 68) as in the first embodiment. The tone pitch evaluation section 82 calculates, for each of the unit segments Tu, tone pitch likelihoods $L_P(n)$ (i.e., $L_P(1)$–$L_P(N)$) for individual ones of the N candidate frequencies $Fc(1)$–$Fc(N)$ identified by the frequency detection section 62. The tone pitch likelihood $L_P(n)$ of each of the unit segments Tu is in the form of a numerical value corresponding to a difference between the reference tone pitch $P_{REF}$ designated by the music piece information $D_M$ for a time point of the music piece corresponding to that unit segment Tu and the candidate frequency Fc(n) detected by the frequency detection section 62. In the second embodiment, where the reference tone pitches $P_{REF}$ correspond to the singing sound of the music piece, the tone pitch likelihood $L_P(n)$ functions as an index of a degree of possibility (likelihood) of the candidate frequency Fc(n) corresponding to the singing sound of the music piece. For example, the tone pitch likelihood $L_P(n)$ is selected from within a predetermined range of positive values equal to and less than "1" such that it takes a greater value as the difference between the candidate frequency Fc(n) and the reference tone pitch $P_{REF}$ decreases.

Figure 19:
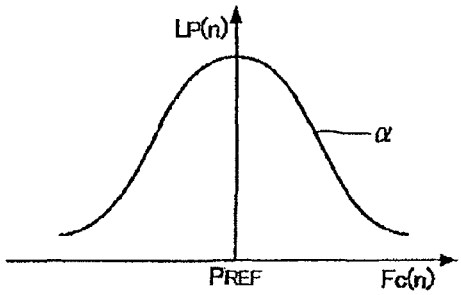
FIG. 19 is a diagram explanatory of a process performed by a tone pitch evaluation section in the second embodiment for selecting a tone pitch likelihood.

FIG. 19 is a diagram explanatory of a process performed by the tone pitch evaluation section 82 for selecting the tone pitch likelihood $L_P(n)$. In FIG. 19, there is shown a probability distribution $\alpha$ with the candidate frequency Fc(n) used as a random variable. The probability distribution $\alpha$ is, for example, a normal distribution with the reference tone pitch $P_{REF}$ used as an average value. The horizontal axis (random variable of the probability distribution $\alpha$) of FIG. 19 represents candidate frequencies Fc(n) in cents.

The tone pitch evaluation section 82 identifies, as the tone pitch likelihood $L_P(n)$, a probability corresponding to a candidate frequency Fc(n) in the probability distribution $\alpha$, for each unit segment within a portion of the music piece where the music piece information $D_M$ designates a reference tone pitch $P_{REF}$ (i.e., where the singing sound exists within the music piece). On the other hand, for each unit segment Tu within a portion of the music piece where the music piece information $D_M$ does not designate any reference tone pitch $P_{REF}$ (i.e., where the singing sound does not exist within the music piece), the tone pitch evaluation section 82 sets the tone pitch likelihood $L_P(n)$ at a predetermined lower limit value.

The frequency of the target component can vary (fluctuate) over time about a predetermined frequency because of a musical expression (rendition style), such as a vibrato. Thus, a shape (more specifically, dispersion) of the probability distribution $\alpha$ is selected such that, within a predetermined range centering on the reference tone pitch $P_{REF}$ (i.e., within a predetermined range where variation of the frequency of the target component is expected), the tone pitch likelihood $L_P(n)$ may not take an excessively small value. For example, frequency variation due to a vibrato of the singing sound covers a range of four semitones (two semitones on a higher-frequency side and two semitones on a lower-frequency side) centering on the target frequency. Thus, the dispersion of the probability distribution $\alpha$ is set to a frequency width of about one semitone relative to the reference tone pitch $P_{REF}$ ($P_{REF} \times 2^{1/12}$) in such a manner that, within a predetermined range of about four semitones centering on the reference tone pitch $P_{REF}$, the tone pitch likelihood $L_P(n)$ may not take an excessively small value. Note that, although frequencies in cents are represented on the horizontal axis of FIG. 19, the probability distribution $\alpha$, where frequencies are represented in hertz (Hz), differs in shape (dispersion) between the higher-frequency side and lower-frequency side sandwiching the reference tone pitch $P_{REF}$.

The first processing section 71 of FIG. 18 reflects the tone pitch likelihood $L_P(n)$, calculated by the tone pitch evaluation section 82, in the probability $\pi_A(v)$ calculated for each candidate frequency Fc(n) at step S44 of FIG. 9. More specifically, the first processing section 71 calculates, as the probability $\pi_A(v)$, a sum of respective logarithmic values of the probabilities $P_A1(n)$ and $P_A2(n)$ calculated at step S42 of FIG. 9, probability $P_A3(n)_v$ calculated at step S43 and tone pitch likelihood $L_P(n)$ calculated by the tone pitch evaluation section 82.

Thus, the higher the tone pitch likelihood $L_P(n)$ of the candidate frequency Fc(n), the greater value does take the probability $\Pi_A(n)$ calculated at step S46. Namely, if the candidate frequency Fc(n) has a higher tone pitch likelihood $L_P(n)$ (namely, if the candidate frequency Fc(n) has a higher likelihood of corresponding to the singing sound of the music piece), the candidate frequency Fc(n) has a higher possibility of being selected as a frequency on the estimated path $R_A$. As explained above, the first processing section 71 in the second embodiment functions as a means for identifying the estimated path $R_A$ through a path search using the tone pitch likelihood $L_P(n)$ of each of the candidate frequencies Fc(n).

Further, the second processing section 72 reflects the tone pitch likelihood $L_P(n)$, calculated by the tone pitch evaluation section 82, in the probabilities $\pi_{BVV}$ and $\pi_{BUV}$ calculated for the sound-generating state Sv at step S54A of FIG. 13. More specifically, the second processing section 72 calculates, as the probability $\pi_{BVV}$, a sum of respective logarithmic values of the probability $P_{B}1_v$ calculated at step S52, probability $_{B}2_vv$ calculated at step S53 and tone pitch likelihood $L_P(n)$ of the candidate frequency Fc(n), corresponding to the selected unit segment Tu, of the estimated path $R_A$. Similarly, the probability $\pi_{BUV}$ is calculated in accordance with the probability $P_{B}1_v$, probability $_{B}2_vv$ and tone pitch likelihood $L_P(n)$.

Thus, the higher the tone pitch likelihood $L_P(n)$ of the candidate frequency Fc(n), the greater value does take the probability $\pi_B$ calculated in accordance with the probability $\pi_{BVV}$ or $\pi_{BUV}$ calculated at step S54C. Namely, the sound-generating state Sv of the candidate frequency Fc(n) having a higher tone pitch likelihood $L_P(n)$ has a higher possibility of being selected as the state train $R_B$. On the other hand, for the candidate frequency Fc(n) within each unit segment Tu where no audio component of the reference tone pitch $P_{REF}$ of the music piece exists, the tone pitch likelihood $L_P(n)$ is set at the lower limit value; thus, for each unit segment Tu where no audio component of the reference tone pitch $P_{REF}$ exists (i.e., unit segment Tu where the non-sound-generating state Su is to be selected), it is possible to sufficiently reduce the possibility of the sound-generating state Sv being erroneously selected. As explained above, the second processing section 72 in the second embodiment functions as a means for identifying the state train $R_B$ through the path search using the tone pitch likelihood $L_P(n)$ of each of the candidate frequencies Fc(n) on the estimated path $R_A$.

The second embodiment can achieve the same advantageous benefits as the first embodiment. Further, because, in the second embodiment, the tone pitch likelihoods $L_P(n)$ corresponding to differences between the individual candidate frequencies Fc(n) and the reference tone pitches $P_{REF}$ designated by the music piece information $D_M$ are applied to the path searches for the estimated path $R_A$ and state train $R_B$, the second embodiment can enhance an accuracy and precision with which to estimate fundamental frequencies Ftar of the target component, as compared to a construction where the tone pitch likelihoods $L_P(n)$ are not used. Alternatively, however, the second embodiment may be constructed in such a manner that the tone pitch likelihoods $L_P(n)$ are reflected in only one of the search for the estimated path $R_A$ by the first processing section 71 and the search for the state train $R_B$ by the second processing section 72.

Note that, because the tone pitch likelihood $L_P(n)$ is similar in nature to the characteristic index value V(n) from the standpoint of an index indicative of a degree of likelihood of corresponding to the target component (singing sound), the tone pitch likelihood $L_P(n)$ may be applied in place of the characteristic index value V(n) (i.e., the index calculation section 64 may be omitted from the construction shown in FIG. 18). Namely, in such a case, the probability $P_A2(n)$ calculated in accordance with the characteristic index value V(n) at step S42 of FIG. 9 is replaced with the tone pitch likelihood $L_P(n)$, and the probability $P_{B}1_v$ calculated in accordance with the characteristic index value V(n) at step S52 of FIG. 13 is replaced with the tone pitch likelihood $L_P(n)$.

The music piece information $D_M$ stored in the storage device 24 may include a designation (track) of a time series of the reference tone pitches $P_{REF}$ for each of a plurality of parts of the music piece, in which case the calculation of the tone pitch likelihood $L_P(n)$ of each of the candidate frequencies Fc(n) and the searches for the estimated path $R_A$ and state train $R_B$ can be performed per such part of the music piece. More specifically, per unit segment Tu, the tone pitch evaluation section 82 calculates, for each of the plurality of parts of the music piece, tone pitch likelihoods $L_P(n)$ ($L_P(1)-L_P(N)$) corresponding to the differences between the reference tone pitches $P_{REF}$ and the individual candidate frequencies Fc(n) of the part. Then, for each of the plurality of parts, the searches for the estimated path $R_A$ and state train $R_B$ using the individual tone pitch likelihoods $L_P(n)$ of that part are performed in the same manner as in the above-described second embodiment. The above-described arrangements can generate a time series of fundamental frequencies Ftar (frequency information $D_F$), for each of the plurality of parts of the music piece.

C. Third Embodiment

Figure 20:
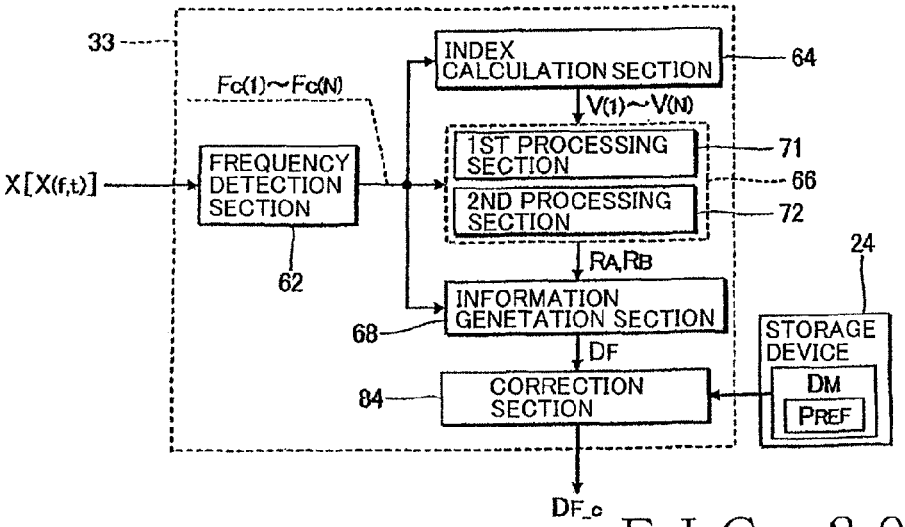
FIG. 20 is a block diagram showing a fundamental frequency analysis section provided in a third embodiment.

FIG. 20 is a block diagram showing the fundamental frequency analysis section 33 provided in the third embodiment. The fundamental frequency analysis section 33 in the third embodiment includes a correction section 84, in addition to the same components (i.e., frequency detection section 62, index calculation section 64, transition analysis section 66 and information generation section 68) as in the first embodiment. The correction section 84 generates a fundamental frequency Ftar_c ("c" means "corrected") by correcting the frequency information $D_F$ (fundamental frequency Ftar) generated by the information generation section 68. As in the second embodiment, the storage device 24 stores therein music piece information $D_M$ designating, in a time-serial fashion, reference tome pitches $P_{REF}$ of the same music piece as represented by the audio signal x.

Figure 21A:
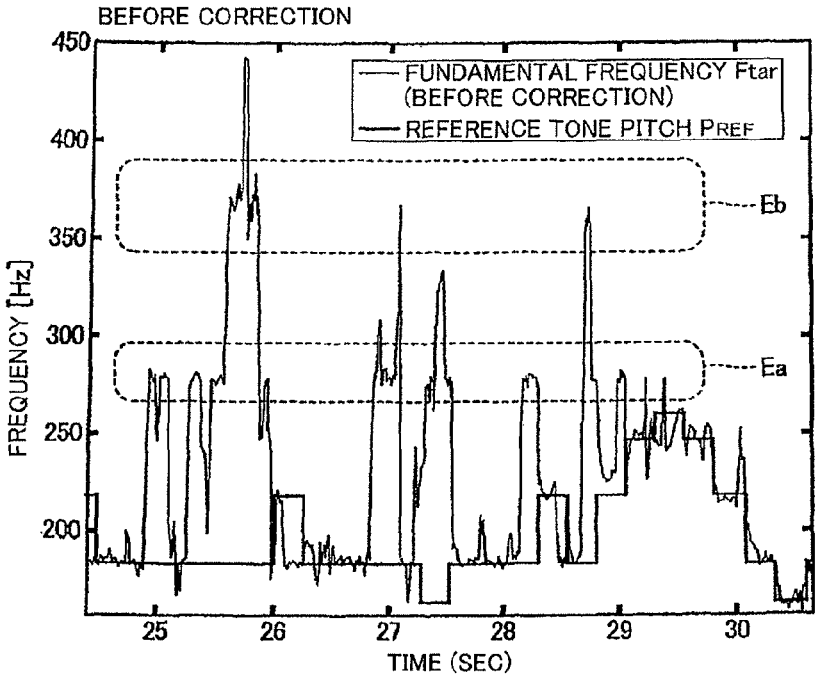
FIGS. 21A and 21B are graphs showing relationship between fundamental frequencies and reference tone pitches before and after correction by a correction section in the third embodiment.

FIG. 21A is a graph showing a time series of the fundamental frequencies Ftar indicated by the frequency information $D_F$ generated by in the same manner as in the first embodiment, and the time series of the reference tome pitches $P_{REF}$ designated by the music piece information $D_M$. As seen from FIG. 21A, there can arise a case where a frequency about one and half times as high as the reference tome pitch $P_{REF}$ is erroneously detected as the fundamental frequency Ftar as indicated by a reference character "Ea" (such erroneous detection will hereinafter be referred to as "five-degree error"), and a case where a frequency about two times as high as the reference tome pitch $P_{REF}$ is erroneously detected as the fundamental frequency Ftar as indicated by a reference character "Eb" (such erroneous detection will hereinafter be referred to as "octave error"). Such a five-degree error and octave error are assumed to be due to the facts among others that harmonics components of the individual audio components of the audio signal x overlap one another and that an audio component at an interval of one octave or fifth tends to be generated within the music piece for musical reasons.

The correction section 84 of FIG. 20 generates frequency information $D_F_c$ (time series of corrected fundamental frequencies Ftar_c) by correcting the above-mentioned errors (particularly, five-degree error and octave error) produced in the time series of the fundamental frequencies Ftar indicated by the frequency information $D_F$. More specifically, the correction section 84 generates, for each of the unity segments Tu, a corrected fundamental frequency Ftar_c by multiplying the fundamental frequency Ftar by a correction value β as represented by mathematical expression (10) below.

$$Ftar_c=\beta\cdot Ftar \tag{10}$$

However, it is not appropriate to correct the fundamental frequency Ftar when there has occurred a difference between the fundamental frequency Ftar and the reference tome pitch $P_{REF}$ due to a musical expression, such as a vibrato, of the singing sound. Therefore, when the fundamental frequency Ftar is within a predetermined range relative to the reference tome pitch $P_{REF}$ designated at a time point of the music piece corresponding to the fundamental frequency Ftar, the correction section 84 determines the fundamental frequency Ftar as the fundamental frequency Ftar_c without correcting the fundamental frequency Ftar. Further, when the fundamental frequency Ftar is, for example, within a range of about three semitones on the higher-pitch side relative to the reference tome pitch PREF (i.e., within a variation range of the fundamental frequency Ftar assumed as a musical expression, such as a vibrato), the correction section 84 does not perform the correction based on mathematical expression (10) above.

Figure 22:
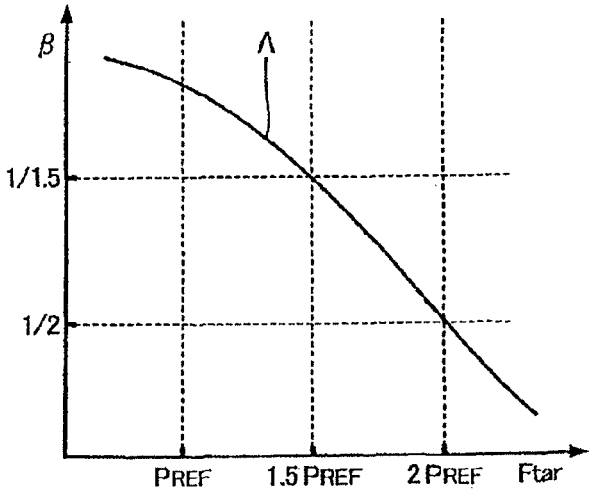
FIG. 22 is a graph showing relationship between fundamental frequencies and correction values.

The correction value β in mathematical expression (10) is variably set in accordance with the fundamental frequency Ftar. FIG. 22 is a graph showing a curve of functions Λ defining relationship between the fundamental frequency Ftar (horizontal axis) and the correction value β (vertical axis). In the illustrated example of FIG. 22, the curve of functions Λ shows a normal distribution. The correction section 84 selects a function Λ (e.g., average and dispersion of the normal distribution) in accordance with the reference tome pitch PREF designated by the music piece information DM in such a manner that the correction value β is 1/1.5 (≈0.67) for a frequency one and half times as high as the reference tome pitch PREF designated at the time point corresponding to the fundamental frequency Ftar (Ftar=1.5 PREF) and the correction value β is 1/2(=0.5) for a frequency two times as high as the reference tome pitch PREF (Ftar=2 PREF).

Figure 21B:
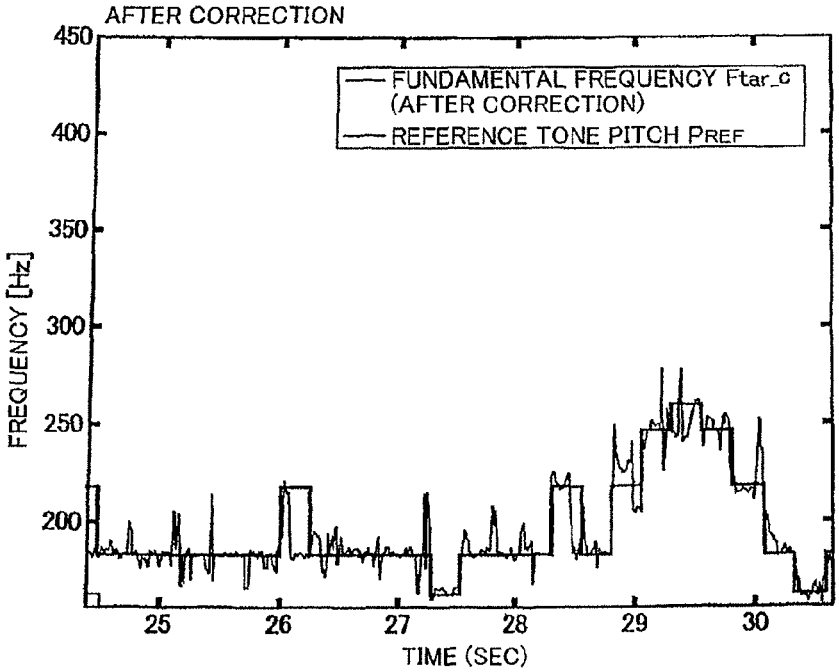

The correction section 84 of FIG. 20 identifies the correction value β corresponding to the fundamental frequency Ftar on the basis of the function Λ corresponding to the reference tome pitch PREF and applies the thus-identified correction value to mathematical expression (10) above. Namely, if the fundamental frequency Ftar is one and half times as high as the reference tome pitch PREF, the correction value β in mathematical expression (10) is set at 1/1.5, and, if the fundamental frequency Ftar is two times as high as the reference tome pitch PREF, the correction value β in mathematical expression (10) is set at 1/2. Thus, as shown in FIG. 21B, the fundamental frequency Ftar erroneously detected as about one and half times as high as the reference tome pitch PREF due to the five-degree error or the fundamental frequency Ftar erroneously detected as about two times as high as the reference tome pitch PREF due to the octave error can each be corrected to a fundamental frequency Ftar_c close to the reference tome pitch PREF.

The third embodiment too can achieve the same advantageous benefits as the first embodiment. Further, the third embodiment, where the time series of fundamental frequencies Ftar analyzed by the transition analysis section 66 is corrected in accordance with the individual reference tone pitches PREF as seen from the foregoing, can accurately detect the fundamental frequencies Ftar_c of the target component as compared to the first embodiment. Because the correction value β where the fundamental frequency Ftar is one and half times as high as the reference tome pitch PREF is set at 1/1.5and the correction value β where the fundamental frequency Ftar is two times as high as the reference tome pitch PREF is set at 1/2 as noted above, the third embodiment can effectively correct the five-degree error and octave error that tend to be easily produced particularly at the time of estimation of the fundamental frequency Ftar.

Whereas the foregoing has described various constructions based on the first embodiment, the construction of the third embodiment provided with the correction section 84 is also applicable to the second embodiment. Further, whereas the correction value β has been described above as being determined using the function Λ indicative of a normal distribution, the scheme for determining the correction value β may be modified as appropriate. For example, the correction value β may be set at 1/1.5 if the fundamental frequency Ftar is within a predetermined rage including a frequency that is one and half times as high as the reference tone pitch PREF (e.g., within a range of a frequency band width that is about one semitone centering on the reference tone pitch PREF) (i.e., in a case where occurrence of a five-degree error is estimated), and the correction value β may be set at 1/2 if the fundamental frequency Ftar is within a predetermined rage including a frequency that is two times as high as the reference tone pitch PREF (i.e., in a case where occurrence of a one octave error is estimated). Namely, it is not necessarily essential for the correction value β to vary continuously relative to the fundamental frequencies Ftar.

D. Fourth Embodiment

The second and third embodiments have been described above on the assumption that there is temporal correspondency between a time series of tone pitches of the target component of the audio signal x and the time series of the reference tone pitches PREF (hereinafter referred to as "reference tone pitch train"). Actually, however, the time series of tone pitches of the target component of the audio signal x and the time series of the reference tone pitch train sometimes do not completely correspond to each other. Thus, a fourth embodiment to be described hereinbelow is construct to adjust a relative position (on the time axis) of the reference tone pitch train to the audio signal x.

Figure 23:
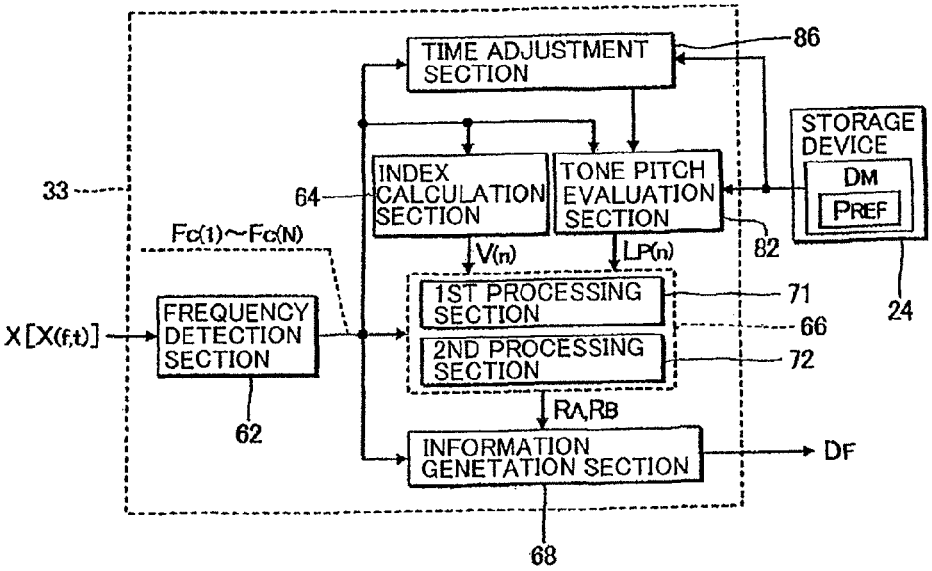
FIG. 23 is a block diagram showing details of a fundamental frequency analysis section provided in a fourth embodiment.

FIG. 23 is a block diagram showing the fundamental frequency analysis section 33 provided in the fourth embodiment. As shown in FIG. 23, the fundamental frequency analysis section 33 in the fourth embodiment includes a time adjustment section 86, in addition to the same components (i.e., frequency detection section 62, index calculation section 64, transition analysis section 66, information generation section 68 and tone pitch evaluation section 82) as the fundamental frequency analysis section 33 in the second embodiment.

The time adjustment section 86 determines a relative position (time difference) between the audio signal x (individual unit segments Tu) and the reference tone pitch train designated by the music piece information DM, designated by the music piece information DM stored in the storage device 24, in such a manner that the time series of tone pitches of the target component of the audio signal x and the reference tone pitch train correspond to each other on the time axis. Whereas any desired scheme or technique may be employed for adjustment, on the time axis, between the audio signal x and the reference tone pitch train, let it be assumed in the following description that the fourth embodiment employs a scheme of comparing a time series of fundamental frequencies Ftar (hereinafter referred to as "analyzed tone pitch train") identified by the information generation section 68 in generally the same manner as in the first embodiment or second embodiment. The analyzed tone pitch train is a time series of fundamental frequencies Ftar identified without the processed results of the time adjustment section 86 (i.e., temporal correspondency with the reference tone pitch train) being taken into account.

The time adjustment section 86 calculates a mutual correlation function C(Δ) between the analyzed tone pitch train of the entire audio signal x and the reference tone pitch train of the entire music piece, with a time difference Δ therebetween used as a variable, and identifies a time difference ΔA with which a function value (mutual correlation) of the mutual correlation function C(Δ) becomes the greatest. For example, the time difference Δ at a time point when the function value of the mutual correlation function C(Δ) changes from an increase to a decrease is determined as the time difference ΔA. Alternatively, the time adjustment section 86 may be constructed to determine the time difference ΔA after smoothing the mutual correlation function C(Δ). Then, the time adjustment section 86 delays (or advances) one of the analyzed tone pitch train and the reference tone pitch train behind (or ahead of) the other by the time difference ΔA. Thus, with the time difference Δ imparted to the analyzed tone pitch train and reference tone pitch train, and for each of the unit segments Tu of the analyzed tone pitch train, a reference tone pitch $P_{REF}$, located at the same time as that unit segment Tu, of the reference tone pitch train can be identified.

The tone pitch evaluation section 82 uses the analyzed results of the time adjustment section 86 to calculate a tone pitch likelihood $L_P(n)$ for each of the unit segments Tu. More specifically, in accordance with a difference between a candidate frequency Fc(n) detected by the frequency detection section 62 for each of the unit segments Tu and a reference tone pitch $P_{REF}$, located at the same time as that unit segment Tu, of the reference tone pitch train having been adjusted (i.e., imparted with the time difference $\Delta_A$) by the time adjustment section 86, the tone pitch evaluation section 82 calculates a tone pitch likelihood $L_P(n)$. As in the above-described second embodiment, the transition analysis section 66 (first and second processing sections 71 and 72) performs the path searches using the tone pitch likelihoods $L_P(n)$ calculated by the tone pitch evaluation section 82. As understood from the foregoing, the transition analysis section 66 sequentially performs a path search for the time adjustment 86 to identify the analyzed tone pitch train to be compared against the reference tone pitch train (i.e., search path without the analyzed results of the time adjustment section 86 taken into account) and a path search with the analyzed results of the time adjustment section 86 taken into account.

The above-described fourth embodiment, where the time adjustment section 86 calculates tone pitch likelihoods $L_P(n)$ between the audio signal x and the reference tone pitch train having been adjusted in time-axial position by the time adjustment section 86, can advantageously identify a time series of fundamental frequencies Ftar with a high accuracy and precision even where the time-axial positions of the audio signal x and the reference tone pitch train do not correspond to each other.

Whereas the fourth embodiment has been described above as applying the analyzed results of the time adjustment section 86 to the calculation, by the tone pitch evaluation section 82, of the tone pitch likelihoods $L_P(n)$, the time adjustment section 86 may be added to the third embodiment so that the analyzed results of the time adjustment section 86 are used for the correction, by the correction section 84, of the fundamental frequency Ftar. Namely, the correction section 84 selects functions Λ such that the correction value β is set at a 1/1.5 if the fundamental frequency Ftar at a given unit segment Tu is one and half times as high as the reference tome pitch $P_{REF}$, located at the same time as that unit segment Tu, of the reference tone pitch train having been adjusted, the correction value β is set at 1/1.5, and that the correction value β is set at 1/2 if the fundamental frequency Ftar is two times as high as the reference tome pitch $P_{REF}$.

Further, whereas the fourth embodiment has been described above as comparing the analyzed tone pitch train and the reference tone pitch train for the entire music piece, it may compare the analyzed tone pitch train and the reference tone pitch train only for a predetermined portion (e.g., portion of about 14 or 15 seconds from the head) of the music piece to thereby identify a time difference ΔA. As another alternative, the analyzed tone pitch train and the reference tone pitch train may be segmented from the respective heads at every predetermined time interval so that corresponding train segments of the analyzed tone pitch train and the reference tone pitch train are compared to calculate a time difference ΔA for each of the train segments. By thus calculating a time difference ΔA for each of the train segments, the fourth embodiment can advantageously identify, with a high accuracy and precision, reference tone pitches $P_{REF}$ corresponding to the individual unit segments Tu even where the analyzed tone pitch train and the reference tone pitch train differ from each other in tempo.

G Modifications

The above-described embodiments may be modified as exemplified below, and two or more of the following modifications may be combined as desired.

(1) Modification 1:

The index calculation section 64 may be dispensed with. In such a case, the characteristic index value V(n) is not applied to the identification, by the first processing section 71, of the path $R_A$ and identification, by the second processing section 72, of the path $R_B$. For example, the calculation of the probability $P_A$2(n) at step S42 is dispensed with, so that the estimated train $R_A$ is identified in accordance with the probability $P_A$1(n) corresponding to the degree of likelihood Ls(Fc(n)) and the probability $P_A$3(n)_ν corresponding to the frequency difference ϵ between adjoining unit segments Tu. Further, the calculation of the probability $P_B$1_v at step S52 of FIG. 13 may be dispensed with, in which case the state train $R_B$ is identified in accordance with the probabilities ($P_B$2_vv, $P_B$2_uv, $P_B$2_uu and $P_B$2_vu) calculated at step S53. Further, the means for calculating the characteristic index value V(n) is not limited to the SVM (Support Vector Machine). For example, a construction using results of learning by a desired conventionally-known technique, such as the k-means algorithm, can also achieve the calculation of the characteristic index value V(n).

(2) Modification 2:

The frequency detection section 62 may detect the N candidate frequencies Fc(1) to Fc(N) using any desired scheme. For example, there may be employed a scheme according to which a probability density function of the fundamental frequencies is estimated with the method disclosed in the patent literature (Japanese Patent Application Laid-open Publication No. 2001-125562) discussed above and then N fundamental frequencies where prominent peaks of the probability density function are identified as the candidate frequencies Fc(1) to Fc(N).

(3) Modification 3:

The frequency information $D_F$ generated by the audio processing apparatus 100 may be used in any desired manner. For example, in the second to fourth embodiments, graphs of the time series of fundamental frequencies Ftar indicated by the frequency information $D_F$ and the time series of reference tone pitches $P_{REF}$ indicated by the music piece information $D_M$ may be displayed simultaneously on the display device so that a user can readily ascertain correspondency between the time series of fundamental frequencies Ftar and the time series of reference tone pitches. For example, time series of fundamental frequencies Ftar may be generated and retained, as model data (instructor information), for individual ones of a plurality of audio signals x differing from each other in singing expression (singing style), so that user's singing can be scored through comparison of a time series of fundamental frequencies Ftar, generated from an audio signal x indicative of a user's singing sound, against each of the model data. Alternatively, time series of fundamental frequencies Ftar may be generated and retained, as model data (instructor information), for individual ones of a plurality of audio signals x of different singers, so that one of the singers similar in singing sound to a user can be identified through comparison of a time series of fundamental frequencies Ftar, generated from an audio signal x indicative of a user's singing sound, against each of the model data.

This application is based on, and claims priorities to, JP PA 2010-242245 filed on 28 Oct. 2010 and JP PA 2011-045975 filed on 3 Mar. 2011. The disclosure of the priority applications, in its entirety, including the drawings, claims, and the specification thereof, are incorporated herein by reference.

What is claimed is:

1. An audio processing apparatus comprising:

a frequency detection section which identifies, for each of unit segments of an audio signal, a plurality of fundamental frequencies;

a first processing section which identifies, through a path search based on a dynamic programming scheme, an estimated train that is a series of fundamental frequencies, each selected from the plurality of fundamental frequencies of a different one of the unit segments, arranged over a plurality of the unit segments and that has a high likelihood of corresponding to a time series of fundamental frequencies of a target component of the audio signal;

a second processing section which identifies, through a path search based on a dynamic programming scheme, a state train that is a series of sound generation states, each indicative of one of a sound-generating state and non-sound-generating state of the target component in a different one of the unit segments, arranged over the plurality of the unit segments; and an information generation section which generates frequency information for each of the unit segments, the frequency information generated for each unit segment corresponding to the sound-generating state in the state train being indicative of one of the fundamental frequencies in the estimated train that corresponds to the unit segment, the frequency information generated for each unit segment corresponding to the non-sound-generating state in the state train being indicative of no sound generation for the unit segment.

2. The audio processing apparatus as claimed in claim 1, wherein said frequency detection section calculates a degree of likelihood with which each frequency component corresponds to the fundamental frequency of the audio signal and selects a plurality of the frequencies having a high degree of the likelihood as fundamental frequencies, and said first processing section calculates, for each of the unit segments and for each of the plurality of the frequencies, a probability corresponding to the degree of likelihood and identifies the estimated train through a path search using the probability calculated thereby for each of the unit segments and for each of the plurality of the frequencies.

3. The audio processing apparatus as claimed in claim 1, which further comprises an index calculation section which calculates, for each of the unit segments and for each of the plurality of the fundamental frequencies, an characteristic index value indicative of similarity and/or dissimilarity between an acoustic characteristic of each of harmonics components corresponding to the fundamental frequencies of the audio signal detected by said frequency detection section and an acoustic characteristic corresponding to the target component, and wherein said first processing section identifies the estimated train through a path search using a probability calculated for each of the unit segments and for each of the plurality of the fundamental frequencies in accordance with the characteristic index value calculated for the unit segment.

4. The audio processing apparatus as claimed in claim 1, wherein said second processing section identifies the state train through a path search using probabilities of the sound-generating state and the non-sound-generating state calculated for each of the unit segments in accordance with a characteristic index value corresponding to the fundamental frequency in the estimated train.

5. The audio processing apparatus as claimed in claim 1, wherein said first processing section identifies the estimated train through a path search using a probability calculated, for each of combinations between the fundamental frequencies identified by said frequency detection section for each one of the plurality of unit segments and the fundamental frequencies identified by said frequency detection section for the unit segment immediately preceding the one unit segment, in accordance with differences between the fundamental frequencies identified for the one unit segment and the fundamental frequencies identified for the immediately-preceding unit segment.

6. The audio processing apparatus as claimed in claim 1, wherein said second processing section identifies the state train through a path search using a probability calculated for a transition between the sound-generating states in accordance with a difference between the fundamental frequency of each one of the unit segments in the estimated train and the fundamental frequency of the unit segment immediately preceding the one unit segment in the estimated train, and a probability calculated for a transition from one of the sound-generating state and the non-sound-generating state to the non-sound-generating state between adjoining ones of the unit segments.

7. The audio processing apparatus as claimed in claim 1, which further comprises:

a supply section adapted to supply a time series of reference tone pitches; and a tone pitch evaluation section which calculates, for each of the plurality of unit segments, a tone pitch likelihood corresponding to a difference between each of the plurality of fundamental frequencies detected by said frequency detection section for the unit segment and the reference tone pitch corresponding to the unit segment, wherein said first processing section identifies the estimated train through a path search using the tone pitch likelihood calculated for each of the plurality of fundamental frequencies, and said second processing section identifies the state train through a path search using probabilities of the sound-generating state and the non-sound-generating state calculated for each of the unit segments in accordance with the tone pitch likelihood corresponding to the fundamental frequency in the estimated train.

8. The audio processing apparatus as claimed in claim 7, which further comprises a time adjustment section which adjusts time-axial positions of a time series of fundamental frequencies based on output of said frequency detection section and the time series of reference tone pitches, the time series of fundamental frequencies comprising fundamental frequencies, each selected from the plurality of fundamental frequencies identified by said frequency detection section for a different one of the unit segments, arranged over a plurality of the unit segments, and wherein, on the basis of the time series of fundamental frequencies and the time series of reference tone pitches having been adjusted in time-axial position by said time adjustment section, said tone pitch evaluation section calculates said tone pitch likelihood for each of the unit segments.

9. The audio processing apparatus as claimed in claim 1, which further comprises:

a supply section adapted to supply a time series of reference tone pitches; and a correction section which corrects the fundamental frequency, indicated by the frequency information, by a factor of 1 divided by 1.5 when the fundamental frequency indicated by the frequency information is within a predetermined range including a frequency that is one and half times as high as the reference tone pitch at a time point corresponding to the frequency information and which corrects the fundamental frequency, indicated by the frequency information, by a factor of 1 divided by 2 when the fundamental frequency is within a predetermined range including a frequency that is two times as high as the reference tone pitch.

10. The audio processing apparatus as claimed in claim 9, which further comprises a time adjustment section which adjusts time-axial positions of a time series of fundamental frequencies based on output of said frequency detection section and the time series of reference tone pitches, the time series of fundamental frequencies comprising fundamental frequencies, each selected from the plurality of fundamental frequencies identified by said frequency detection section for a different one of the unit segments, arranged over a plurality of the unit segments, and wherein said correction section corrects the fundamental frequency on the basis of the time series of fundamental frequencies and the time series of reference tone pitches having been adjusted in time-axial position by said time adjustment section.

11. A computer-implemented method for processing an audio signal, comprising:

a step of identifying, for each of unit segments of the audio signal, a plurality of fundamental frequencies;

a step of identifying, through a path search based on a dynamic programming scheme, an estimated train that is a series of fundamental frequencies, each selected from the plurality of fundamental frequencies of a different one of the unit segments, arranged sequentially over a plurality of the unit segments and that has a high likelihood of corresponding to a time series of fundamental frequencies of a target component of the audio signal;

a step of identifying, through a path search based on a dynamic programming scheme, a state train that is a series of states, each indicative of one of a sound-generating state and non-sound-generating state of the target component in a different one of the unit segments, arranged sequentially over the plurality of the unit segments; and a step of generating frequency information for each of the unit segments, the frequency information generated for each unit segment corresponding to the sound-generating state in the state train being indicative of one of the selected fundamental frequencies in the estimated train that corresponds to the unit segment, the frequency information generated for each unit segment corresponding to the non-sound-generating state in the state train being indicative of no sound generation for the unit segment.

12. A non-transitory computer-readable storage medium storing a group of instructions for causing a computer to perform a method for processing an audio signal, said method comprising:

a step of identifying, for each of unit segments of the audio signal, a plurality of fundamental frequencies;

a step of identifying, through a path search based on a dynamic programming scheme, an estimated train that is a series of fundamental frequencies, each selected from the plurality of fundamental frequencies of a different one of the unit segments, arranged sequentially over a plurality of the unit segments and that has a high likelihood of corresponding to a time series of fundamental frequencies of a target component of the audio signal;

a step of identifying, through a path search based on a dynamic programming scheme, a state train that is a series of states, each indicative of one of a sound-generating state and non-sound-generating state of the target component in a different one of the unit segments, arranged sequentially over the plurality of the unit segments; and a step of generating frequency information for each of the unit segments, the frequency information generated for each unit segment corresponding to the sound-generating state in the state train being indicative of one of the selected fundamental frequencies in the estimated train that corresponds to the unit segment, the frequency information generated for each unit segment corresponding to the non-sound-generating state in the state train being indicative of no sound generation for the unit segment.

* * * * *